US010059115B2

(12) United States Patent
Kuribayashi

(10) Patent No.: US 10,059,115 B2
(45) Date of Patent: Aug. 28, 2018

(54) LIQUID DISCHARGING APPARATUS AND METHOD FOR ADJUSTING PRESSURE OF LIQUID THEREIN

(71) Applicant: TOSHIBA TEC KABUSHIKI KAISHA, Tokyo (JP)

(72) Inventor: Yasushi Kuribayashi, Mishima Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 3 days.

(21) Appl. No.: 15/389,211

(22) Filed: Dec. 22, 2016

(65) Prior Publication Data

US 2017/0100941 A1 Apr. 13, 2017

Related U.S. Application Data

(62) Division of application No. 14/844,806, filed on Sep. 3, 2015, now abandoned.

(30) Foreign Application Priority Data

Sep. 4, 2014 (JP) ..... 2014-180545

(51) Int. Cl.
*B41J 2/175* (2006.01)

(52) U.S. Cl.
CPC ..... *B41J 2/17596* (2013.01)

(58) Field of Classification Search
CPC .... B41J 2/17596; B41J 2/175; B41J 2/17509; B41J 2202/12; F04B 3/00; A61M 5/1452
See application file for complete search history.

(56) References Cited

U.S. PATENT DOCUMENTS

| | | | | |
|---|---|---|---|---|
| 3,728,047 | A | | 4/1973 | Mangialardi |
| 4,343,596 | A | | 8/1982 | Shimazawa et al. |
| 5,561,448 | A | * | 10/1996 | Kaneko ..... B41J 2/16508 347/29 |
| 5,619,232 | A | | 4/1997 | Maeno |
| 5,961,258 | A | | 10/1999 | Ende et al. |
| 6,948,803 | B2 | | 9/2005 | Yoshida et al. |
| 8,636,346 | B2 | | 1/2014 | Borra et al. |
| 2001/0020970 | A1 | | 9/2001 | Kuribayashi et al. |

(Continued)

FOREIGN PATENT DOCUMENTS

JP 2008155603 A 7/2008

*Primary Examiner* — John P Zimmermann
(74) *Attorney, Agent, or Firm* — Patterson & Sheridan, LLP

(57) ABSTRACT

A liquid discharge apparatus includes a head, a first tank to which liquid is recovered from the head, a second tank that is connected to the first tank and from which liquid is supplied to the head, a pressure regulator configured to adjust a pressure of the liquid, and a controller configured to control the pressure regulator. The pressure regulator includes a first cylinder connected to an upper portion of the first tank, a first piston movable in the first cylinder, a first valve configured to open and close a path between the first tank and the first cylinder, depending on a position of the first piston, a second cylinder connected to the first cylinder, a second piston movable in the second cylinder, and a second valve configured to open and close a path between the second cylinder and an atmosphere, depending on a position of the second piston.

17 Claims, 15 Drawing Sheets

(56) References Cited

U.S. PATENT DOCUMENTS

| | | | | |
|---|---|---|---|---|
| 2004/0261894 | A1* | 12/2004 | Ryu | G02F 1/1341 141/94 |
| 2005/0024397 | A1 | 2/2005 | Mizoguchi | |
| 2006/0132554 | A1 | 6/2006 | Ota et al. | |
| 2008/0151014 | A1 | 6/2008 | Matsuda | |
| 2011/0002802 | A1 | 1/2011 | Capone et al. | |
| 2013/0153684 | A1* | 6/2013 | Taranta | B05B 9/0409 239/337 |
| 2013/0194361 | A1 | 8/2013 | Takahashi | |

* cited by examiner

LIQUID DISCHARGING APPARATUS AND METHOD FOR ADJUSTING PRESSURE OF LIQUID THEREIN

CROSS-REFERENCE TO RELATED APPLICATION

This application is a division of U.S. patent application Ser. No. 14/844,806, filed on Sep. 3, 2015, which claims the benefit of priority from Japanese Patent Application No. 2014-180545, filed Sep. 4, 2014, the entire contents of which are incorporated herein by reference.

FIELD

Embodiments described herein relate generally to a liquid discharging apparatus and a method for adjusting pressure of liquid therein.

BACKGROUND

A liquid discharge apparatus of one type circulates liquid, such as ink, through a head and a tank. The liquid is circulated through a flow channel including a pressure chamber corresponding to a nozzle, and the liquid is discharged from the nozzle of the head. More specifically, the liquid is supplied from the tank to the head, and liquid that is not discharged from the nozzle is conveyed to the tank.

In such a liquid discharge apparatus, in order to circulate the liquid stably, the pressure is controlled. A mechanism for controlling the pressure may be, for example, a bellows connected to the tank and operating the bellows such that the volume in the bellows changes due to the expansion and contraction thereof.

DETAILED DESCRIPTION

Figure 1:
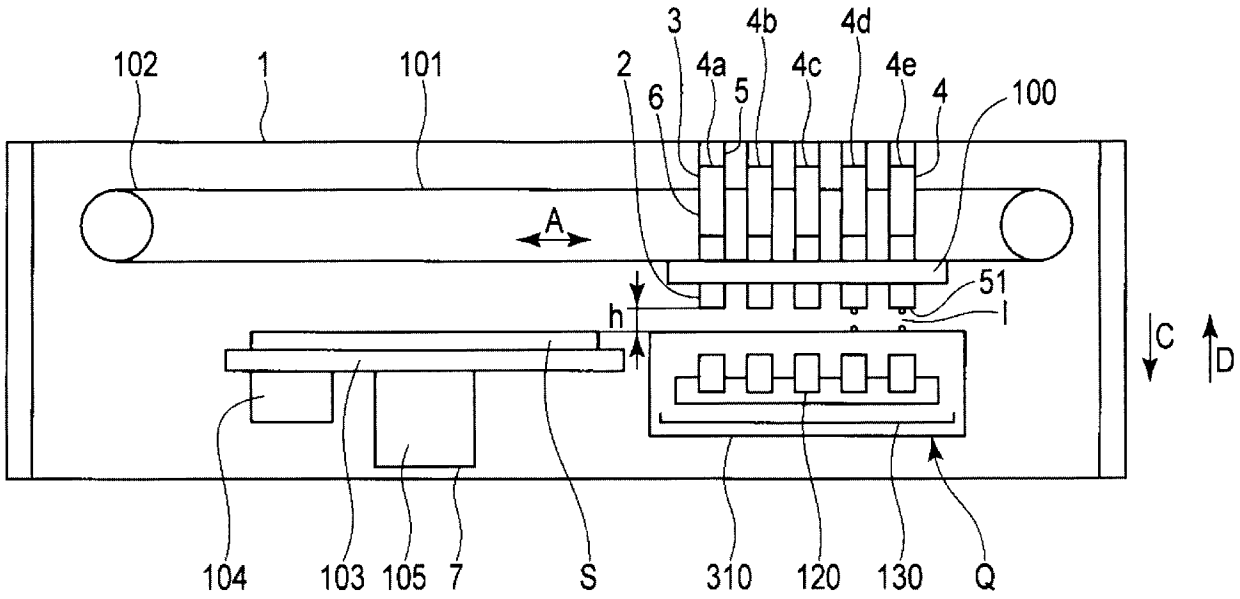
FIG. 1 is a side view of an inkjet printing apparatus according to a first embodiment.

A relatively compact liquid discharge apparatus is provided. A liquid discharge apparatus including a bellows generally has a large size because it is necessary to provide a clearance around the bellows to secure a certain range of possible volume change (bellows expansion) so the pressure may be adjusted. Additionally, a bellows typically requires several actuators for operation.

In general, according to an embodiment, a liquid discharge apparatus includes a head, for example an ink jet head, including one or more nozzles for discharging a liquid, for example an ink, a tank unit having a first tank to which liquid is recovered (returned) from the head and a second tank that is connected to the first tank and from which liquid is supplied to the head, a pressure regulator configured to adjust a pressure applied to the liquid, and a controller configured to control the pressure regulator. The pressure regulator includes a first cylinder connected to an upper portion of the first tank, a first piston movable in the first cylinder, a first valve configured to open and close a path between the first tank and the first cylinder according to a position of the first piston, a second cylinder connected to the first cylinder, a second piston movable in the second cylinder, and a second valve configured to open and close a path between the second cylinder and an atmosphere according to a position of the second piston.

First Embodiment

Hereinafter, an inkjet printing apparatus 1 according to a first embodiment will be described with reference to FIG. 1 to FIG. 11. In each drawing, configurations as illustrated are appropriately enlarged, reduced, or omitted for descriptive purposes. The same structure or similar structures are designated by the same reference numeral.

Figure 2:
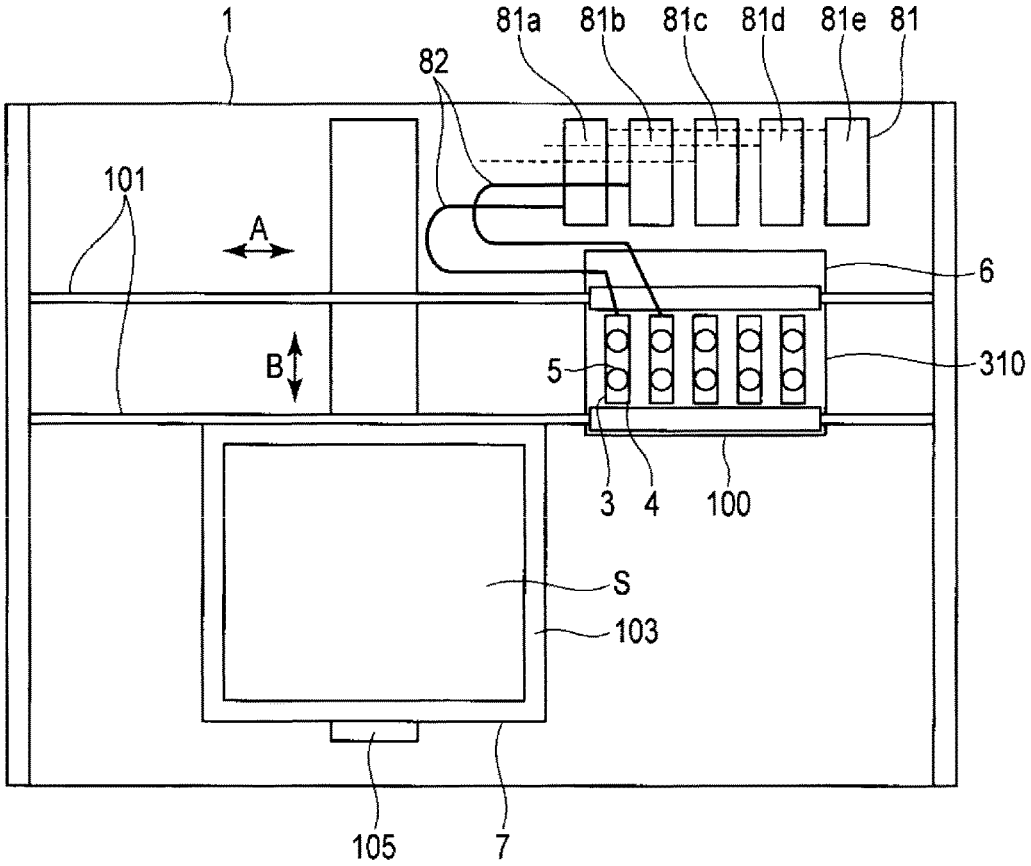
FIG. 2 is a top view of the inkjet printing apparatus.

FIG. 1 is a side view of the inkjet printing apparatus 1, and FIG. 2 is a plan view of the inkjet printing apparatus 1. As illustrated in FIG. 1 and in FIG. 2, the inkjet printing apparatus 1, which is a liquid discharging apparatus, includes an image forming unit 6, a printing medium moving unit 7, which is a transporting unit, and a maintenance unit 310.

The image forming unit 6 includes an inkjet printing unit 4, a carriage 100 that supports the inkjet printing unit 4, a transport belt 101 that causes the carriage 100 to reciprocate in the directions of an arrow A, and a carriage motor 102 that drives the transport belt 101.

The inkjet printing unit 4 includes an inkjet head 2 that is a liquid discharging unit, an ink circulating device 3 that is a circulating unit, and a pressure adjusting unit 5.

The ink circulating device 3 is above the inkjet head 2 and is integrated with the inkjet head 2. The inkjet printing unit 4 discharges ink to a printing medium S and forms a desired image.

The inkjet printing unit 4 includes inkjet printing units 4*a*, 4*b*, 4*c*, 4*d*, and 4*e* that respectively discharge, for example, cyan ink, magenta ink, yellow ink, black ink, and white ink. The color or characteristics of the ink that each of the inkjet printing units 4*a*, 4*b*, 4*c*, 4*d*, and 4*e* uses are not limited. For example, the inkjet printing unit 4*e* may discharge a transparent gloss ink, a special ink that develops color when being irradiated with an infrared or ultraviolet ray, and the like, instead of a white ink. The inkjet printing units 4*a*, 4*b*, 4*c*, 4*d*, and 4*e* have the same configuration except for the inks that each thereof uses. Therefore, the inkjet printing units 4*a*, 4*b*, 4*c*, 4*d*, and 4*e* will be collectively described by using a common reference sign.

The width of the inkjet printing unit 4 is decreased by stacking the ink circulating device 3 on the inkjet head 2. Therefore, the width of the carriage 100 that supports the inkjet printing units 4*a* to 4*e* in a parallel manner may be decreased. By decreasing the width of the carriage 100 of the image forming unit 6, the distance by which the carriage 100 is transported may be decreased, and the inkjet printing apparatus 1 may have a smaller size and a higher printing speed.

The image forming unit 6 includes an ink cartridge 81 so as to replenish the ink circulating device 3 with new ink. Ink cartridges 81*a*, 81*b*, 81*c*, 81*d*, and 81*e* of the ink cartridge 81 respectively contain cyan ink, magenta ink, yellow ink, black ink, and white ink. The ink cartridges 81*a*, 81*b*, 81*c*, 81*d*, and 81*e* have the same configuration except for the ink that each thereof holds. Therefore, the ink cartridges 81*a*, 81*b*, 81*c*, 81*d*, and 81*e* will be described by using a common reference sign. The ink cartridge 81 communicates with the ink circulating device 3 of the inkjet printing unit 4 through a tube 82. The ink cartridge 81 is arranged relatively below the ink circulating device 3 in the direction of gravity.

The printing medium moving unit 7 includes a table 103 that suctions the printing medium S. The table 103 is provided on a slide rail device 105 and reciprocates in the directions of an arrow B. The table 103 suctions the printing medium S from a small diameter holes formed on the upper face thereof by generating negative pressure inside the table 103 with a pump 104. While the inkjet printing unit 4 reciprocates along the transport belt 101 in the directions of the arrow A, a distance h between a nozzle plate 52 of the inkjet head 2 and the printing medium S is maintained to be constant. The inkjet head 2 includes 300 nozzles 51, which are liquid discharging units, in the longitudinal direction of the nozzle plate 52. The longitudinal direction of the nozzle plate 52 is the same as the direction in which the printing medium S is conveyed (medium conveying direction).

The image forming unit 6 forms an image on the printing medium S by causing the inkjet head 2 to reciprocate in the directions orthogonal to the medium conveying direction. The inkjet head 2 causes ink I to be discharged from the nozzles 51 arranged on the nozzle plate 52 in accordance with an image formation signal and forms an image on the printing medium S. The inkjet printing unit 4 forms an image having, for example, the same width as the 300 nozzles 51 on the printing medium S.

The maintenance unit 310 is arranged at a position outside the area of movement of the table 103 and in the area of scanning performed by the inkjet printing unit 4 in the directions of the arrow A. The inkjet head 2 faces the maintenance unit 310 at a standby position Q. The maintenance unit 310 is a case that is open upward and is arranged to be capable of moving up and down (in the directions of arrows C and D in FIG. 1).

The maintenance unit 310 moves downward (in the direction of the arrow C) and apart from the nozzle plate 52 when the carriage 100 moves in the directions of the arrow A so as to print an image. When the print operation ends, the maintenance unit 310 moves upward (in the direction of the arrow D). When the inkjet head 2 returns to the standby position Q after the print operation ends, the maintenance unit 310 moves upward and covers the nozzle plate 52 of the inkjet head 2. The maintenance unit 310 prevents evaporation of ink from the nozzle plate 52 and prevents dust or paper dust from adhering to the nozzle plate 52. The maintenance unit 310 functions as a cap of the nozzle plate 52.

The maintenance unit 310 includes a rubber blade 120 and a waste ink receiving unit 130. The rubber blade 120 removes ink, dust, paper dust, and the like that adhere to the nozzle plate 52 of the inkjet head 2. The waste ink receiving unit 130 receives waste ink, dust, paper dust, and the like that are generated during a maintenance operation. The maintenance unit 310 includes a mechanism that causes the blade 120 to move in the directions of the arrow B. The maintenance unit 310 wipes the surface of the nozzle plate 52 with the blade 120.

The inkjet head 2 performs maintenance (spitting function) in which ink is forcibly discharged from the nozzles 51 so as to remove ink that is degraded in the vicinity of the nozzles. The inkjet head 2 performs maintenance (purging function) in which a small amount of ink is caused to flow out of the nozzles 51 so as to capture paper dust or dust, which adheres to the surface of the inkjet head 2, inside the film of the ink that flows out of the nozzles 51 and is wiped with the blade 120. The waste ink receiving unit 130 receives waste ink that is generated due to a spitting function or due to a purging function.

The inkjet printing apparatus 1 is a so-called serial inkjet printing apparatus that forms an image on the printing medium S by causing ink to be discharged from the nozzles 51 while causing the inkjet head 2 to reciprocate in the directions orthogonal with respect to the direction in which the printing medium S is being transported by the printing medium moving unit 7.

Figure 6:
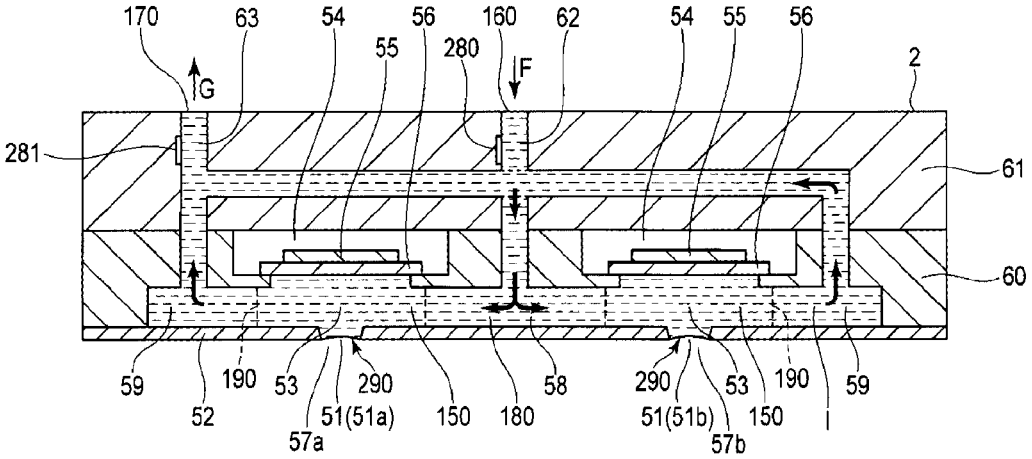
FIG. 6 is a descriptive diagram of an inkjet head in the ink jet printing apparatus according to the first embodiment.
Figure 7:
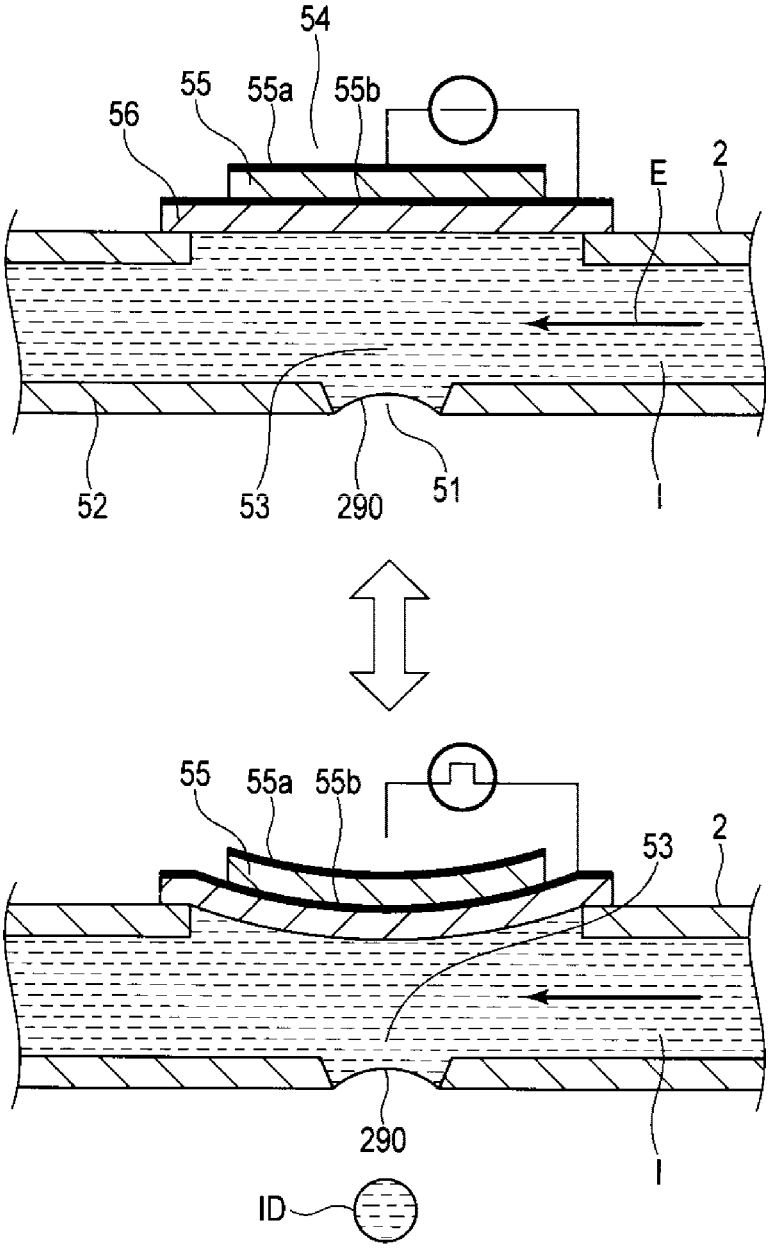
FIG. 7 schematically illustrates discharge of ink from the inkjet head.

The inkjet head 2, for example, as illustrated in FIG. 6 and FIG. 7, includes the nozzle plate 52 that includes the nozzles 51, a substrate 60 that includes an actuator 54, and a manifold 61 that is connected to the substrate 60. The substrate 60 includes an ink flow path 180 in which ink flows between the nozzle 51 and the actuator 54. The actuator 54 faces the ink flow path 180 and one is provided in correspondence with each of the nozzles 51.

The substrate 60 includes a boundary wall 190 between adjacent nozzles 51 so that the pressure exerted on the ink inside the ink flow path 180 by the actuator 54 is concentrated on the ink at the nozzle 51. The portion of the ink flow path 180 surrounded by the nozzle plate 52, the actuator 54, and the boundary wall 190 is an ink pressure chamber 150. The ink pressure chamber 150 is arranged in plural numbers and corresponds to one of nozzles 51*a* in a first nozzle array 57*a* or one of nozzles 51*b* in a second nozzle array 57*b*. The first nozzle array 57*a* and the second nozzle array 57*b* have 300 nozzles 51*a* and 300 nozzles 51*b*, respectively.

The substrate 60 includes a common ink supply chamber 58 and two common ink chambers 59. The ink is supplied from the common ink supply chamber 58 to the plurality of pressure chambers 150. The common ink chambers 59 are provided on the side of the first nozzle array 57*a* and on the side of the second nozzle array 57*b* of the substrate 60, and the ink from the plurality of ink pressure chambers 150 is collected in one of the common ink chambers 59.

The manifold 61 includes an ink supply port 160 and an ink discharge port 170. The ink supply port 160 is a liquid supply port through which ink flows in the direction of an arrow F. The ink discharge port 170 is a liquid discharge port through which ink is discharged in the direction of an arrow G. The ink I is supplied to the ink supply port 160 from the ink circulating device 3, and ink flows back into the ink circulating device 3 from the ink discharge port 170. The manifold 61 includes an ink distribution passageway 62 that communicates with the common ink supply chamber 58 from the ink supply port 160. The manifold 61 includes an ink circulation passageway 63 that communicates with the ink discharge port 170 from the common ink chambers 59.

That is, the ink flow path 180 is formed inside the inkjet head 2 by the substrate 60, the manifold 61, and the nozzle plate 52. The ink flow path 180 includes the plurality of ink pressure chambers 150 that communicate with the nozzles 51*a* and 51*b*, the ink supply port 160 and the ink discharge port 170 that are formed in the manifold 61, the common ink supply chamber 58 that communicates with the plurality of ink pressure chambers 150, the common ink chambers 59 to which ink flows from the plurality of ink pressure chambers 150, the ink distribution passageway 62 that connects the common ink supply chamber 58 and the ink supply port 160, and the ink circulation passageway 63 that connects the ink discharge port 170 and the common ink chambers 59.

The ink I that flows in the ink distribution passageway 62 in the direction of the arrow F flows into the plurality of ink pressure chambers 150 from the common ink supply chamber 58. A nozzle branch unit 53 is a portion that causes the ink flowing in the direction of an arrow E to be separated into the ink that is discharged from the nozzle 51 and the ink that flows through the inkjet head 2 and returns to the ink circulating device 3. That is, part of the ink I flows into the ink pressure chamber 150 from one end portion thereof, passes through the nozzle branch unit 53, and flows out of the other end portion of the ink pressure chamber 150. Also, another part of the ink in the ink pressure chamber 150 is discharged from the nozzle 51 at the nozzle branch unit 53, and the remaining ink flows out of the other end portion of the ink pressure chamber 150. The ink I that is not discharged from the nozzle 51 in the ink pressure chamber 150 flows into the common ink chamber 59 and flows back into the ink circulation passageway 63.

The actuator 54 of the inkjet head 2 includes, for example, a unimorph piezoelectric vibrating plate that includes a piezoelectric element 55 and a vibrating plate 56 that are stacked. The piezoelectric element 55 is formed of a piezoelectric ceramic material and the like such as a PZT (lead zirconate titanate). The vibrating plate 56 is formed of, for example, silicon nitride (SiN).

The piezoelectric element 55 includes electrodes 55*a* and 55*b* on both surfaces of the piezoelectric element 55 as illustrated in FIG. 7. When voltage is not applied to the electrodes 55*a* and 55*b*, the piezoelectric element 55 is not deformed, and thus the actuator 54 is not deformed. When the actuator 54 is not deformed, a meniscus 290, which is an interface between the ink I and the air, is formed in the nozzle 51 due to the surface tension of ink. The ink I inside the ink pressure chamber 150 remains in the nozzle 51 due to the meniscus 290.

When voltage (V) is applied to the electrodes 55*a* and 55*b*, the piezoelectric element 55 is deformed, and thus the actuator 54 is deformed. When the actuator 54 is deformed, the pressure applied to the meniscus 290 becomes higher than atmospheric pressure (positive pressure), and the ink I breaks the meniscus 290 and is discharged from the nozzle 51 as an ink drop ID.

The inkjet head causes a pressure change on the ink inside the ink pressure chamber, and the structure thereof is not limited. The inkjet head, for example, may have a structure in which ink drops are discharged by deforming the vibrating plate with static electricity or have a structure in which ink drops are discharged from the nozzles using thermal energy such as a heater. Since variation of ink temperature affects the viscosity of ink and thus affects characteristics of ink discharge from the nozzles, the inkjet head may be provided with a temperature sensor so as to control the discharge of ink.

An in-head temperature sensor (upstream) 280 is provided on the ink distribution passageway 62 so as to detect the temperature of ink supplied to the inkjet head 2. An in-head temperature sensor (downstream) 281 that detects the temperature of ink discharged from the inkjet head 2 is provided on the ink circulation passageway 63. The in-head temperature sensors 280 and 281 detect the temperature of ink that is supplied into the inkjet head 2 or is discharged from the inkjet head 2. The ink circulating device 3 is controlled with consideration of a change in the viscosity of ink depending on the temperature of ink inside the inkjet head 2.

The ink I moves in the inkjet head 2 in order of the ink supply port 160, the ink distribution passageway 62, the common ink supply chamber 58, the ink pressure chamber 150, the common ink chamber 59, the ink circulation passageway 63, and the ink discharge port 170. Portion of the ink I is discharged from the nozzles 51 in accordance with an image signal, and the remaining ink I flows into the ink circulating device 3 from the ink discharge port 170.

Figure 3:
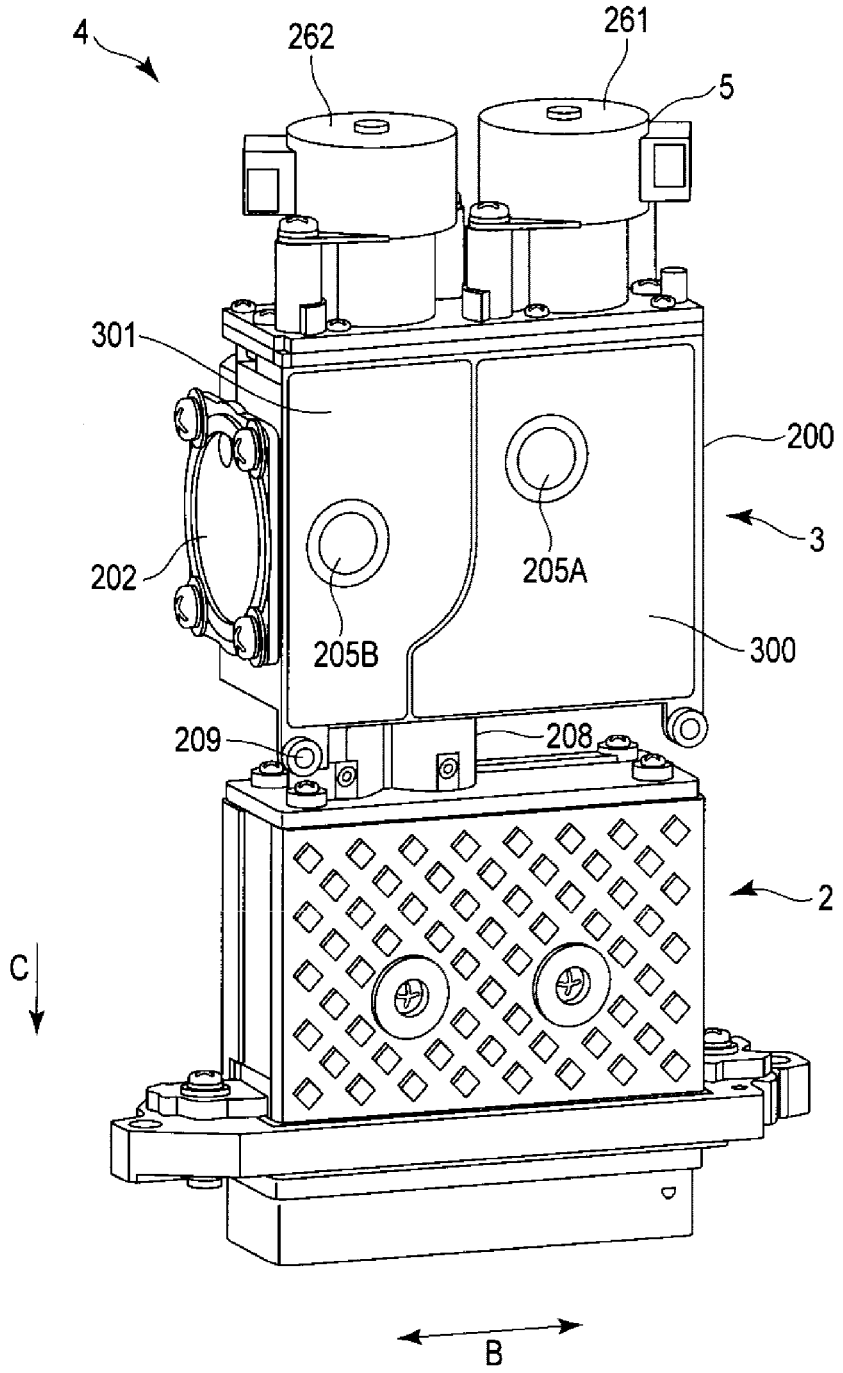
FIG. 3 is a perspective view of an inkjet printing unit in the ink jet printing apparatus according to the first embodiment.
Figure 4:
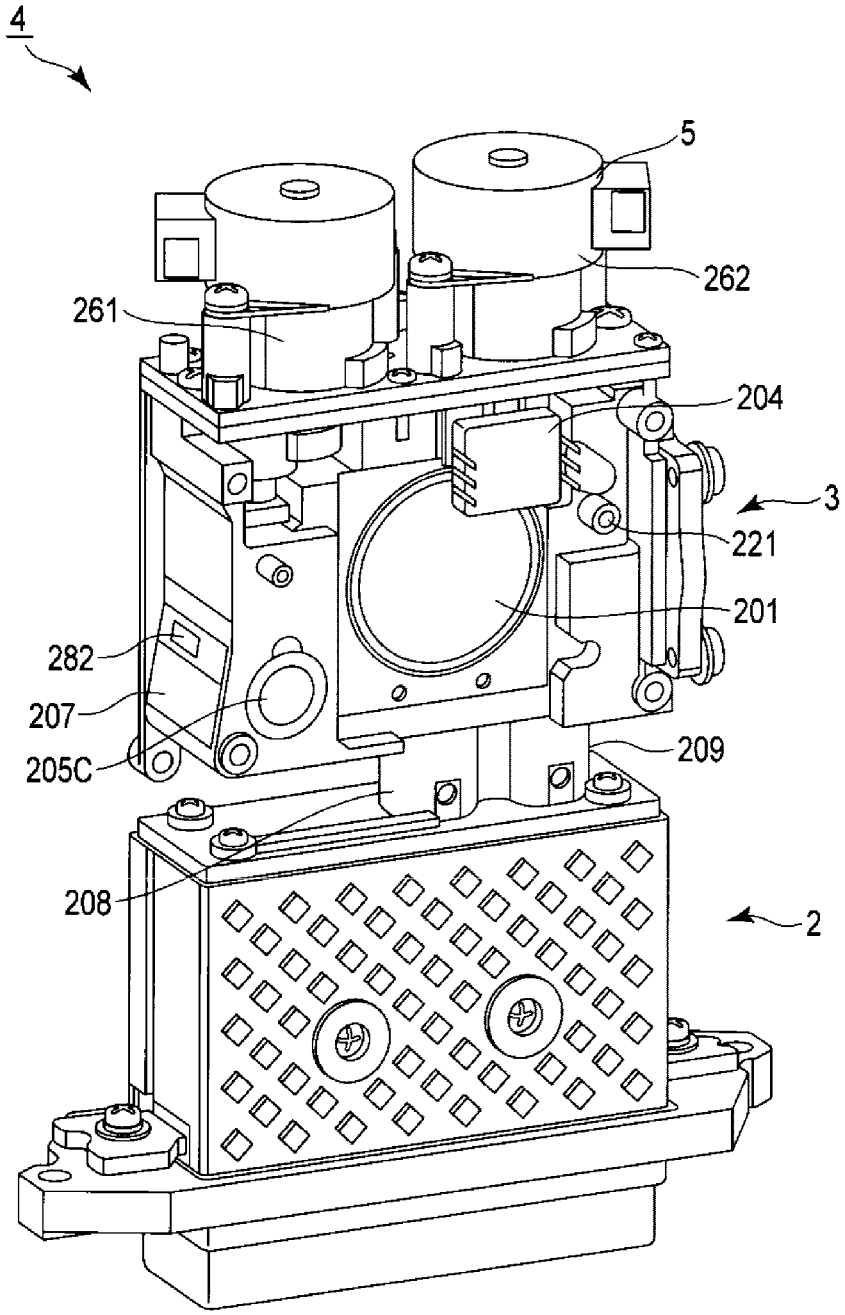
FIG. 4 is a perspective view of the inkjet printing unit from an angle different from an angle of FIG. 3.
Figure 5:
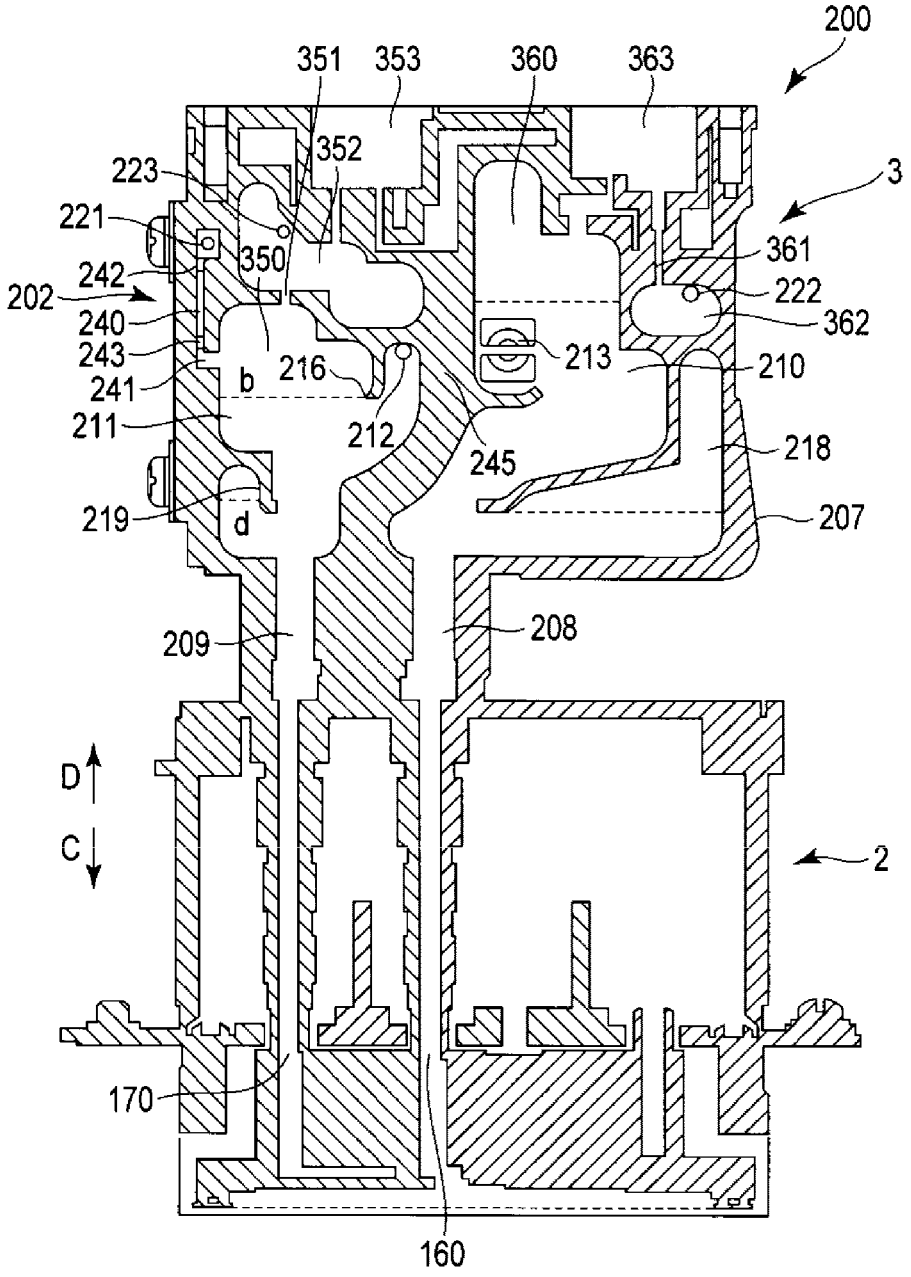
FIG. 5 is a cross-sectional diagram of the inkjet printing unit.

The ink circulating device 3, as illustrated in FIG. 3 to FIG. 5, includes an ink casing 200, an ink circulating pump 201 that circulates the ink, and an ink supply pump 202 that supplies ink to the ink casing 200 from the ink cartridge 81.

The ink casing 200 is formed of aluminum, and resin plates 300 and 301, that are formed of a polyimide resin, are fixed thereto with an adhesive. The ink casing 200 and the resin plates 300 and 301 is a frame portion and forms an empty chamber therein. In the ink casing 200, a supply-side ink chamber 210 that communicates with the inkjet head 2 through an ink supply tube 208 and a collection-side ink chamber 211 that communicates with the inkjet head 2 through an ink return tube 209 are integrally formed adjacent to each other through a common wall 245. The ink casing 200 includes a drawing hole 212 through which ink is drawn from the collection-side ink chamber 211 and a discharge hole 213 through which ink is transported to the supply-side ink chamber 210. Two recessed portions 353 and 363 are formed in the upper portion of the ink casing 200. Projecting portions 372 and 370 of the pressure adjusting unit 5 illustrated in FIG. 9 fit respectively in the recessed portions 353 and 363.

The direction in which the collection-side ink chamber 211 and the supply-side ink chamber 210 are aligned is the same as the direction in which the nozzles of the inkjet head 2 are arranged (longitudinal direction of the inkjet head 2 (direction of the arrow B)). That is, the direction in which the collection-side ink chamber 211 and the supply-side ink chamber 210 are aligned is substantially orthogonal with respect to the direction of scanning performed by the carriage 100. The space in the collection-side ink chamber 211 above an ink surface b is a first gas chamber 350 of the pressure adjusting unit 5. The space in the supply-side ink chamber 210 above an ink surface a is a second gas chamber 360 of the pressure adjusting unit 5.

The ink circulating pump 201, as illustrated in FIG. 3, is arranged on a surface of the ink casing 200 opposite to a surface formed with the first plate 300 and the second plate 301 and on both of the adjacent collection-side ink chamber 211 and the supply-side ink chamber 210. The ink circulating pump 201 suctions ink from the drawing hole 212 and transports the ink to the supply-side ink chamber 210 through the discharge hole 213. The ink circulating pump 201 is a piezoelectric pump, which is similar to the ink supply pump 202. In the ink circulating pump 201, ink is transported by periodically changing the volume of the pump (pump chamber) through deformation of a piezoelectric vibrating plate that has a piezoelectric element and a metal plate bonded together, and the direction of transport of the ink is limited to one direction by two check valves. One check valve of the ink circulating pump 201 is arranged between the drawing hole 212 and the pump chamber, and the other check valve is arranged between the pump chamber and the discharge hole 213. When ink flows into the pump chamber, the one check valve is opened, and the other check valve is closed. When ink flows out of the pump chamber, the one check valve is closed, and the other check valve is opened. By repeating these, ink is transported from the collection-side ink chamber to the supply-side ink chamber.

The ink supply pump 202 is formed on an outer wall of the ink casing 200. The supply pump 202 is a piezoelectric pump and supplies the amount of ink consumed in the print operation or the maintenance operation or the like to the collection-side ink chamber 211 in the ink circulating device 3 from an ink supply port 221. The tube 82 that transports ink to the ink circulating device 3 from the ink cartridge 81 is connected to the ink supply port 221 that is a port through which ink flows into the ink supply pump 202.

In the ink supply pump 202, ink is transported by periodically changing the volume of the pump (pump chamber 240) through deformation of a piezoelectric vibrating plate that includes a piezoelectric element and a metal plate bonded together, and the transport direction of the ink is set to one direction by two check valves. One check valve 242 of the ink supply pump 202 is arranged between the ink supply port 221 and the pump chamber 240, and the other check valve 243 is arranged between the pump chamber 240 and an ink outlet 241. When the pump chamber 240 expands through deformation of the piezoelectric vibrating plate, the check valve 242 is opened to cause ink to flow into the pump chamber 240, and the check valve 243 is closed. When the pump chamber 240 contracts through deformation of the piezoelectric vibrating plate in the reverse direction, the check valve 242 is closed, and the check valve 243 is opened to cause ink to flow out of the pump chamber 240. By repeating these, the ink is transported.

A control circuit board (control unit) 500 is held in the inkjet printing unit 4 so as to cover the ink circulating pump 201. The control circuit board (control unit) 500 controls the ink circulating pump 201, the ink supply pump 202, and the pressure adjusting unit 5.

An ink amount measuring sensor 205A that measures the amount of ink in the ink casing 200 is provided on the first plate 300. Similarly, an ink amount measuring sensor 205B is provided on the second plate 301. An ink vibrator 205C is formed of a piezoelectric vibrating plate and attached to the ink casing 200. Ink in the ink casing 200 is vibrated by the piezoelectric vibrating plate with alternating current voltage. The vibration of ink transmitted in the ink casing 200 which is caused by the ink vibrator 205C is detected by the ink amount measuring sensors 205A and 205B, and the amount of ink is measured.

A heater 207 that heats ink so as to adjust the viscosity of the ink in the ink casing 200 is provided in the outer portion of the ink casing 200. The heater 207 is bonded to the ink casing 200 with an adhesive that has high thermal conductivity. An ink temperature sensor 282 is provided on the vicinity of the heater 207 of the ink casing 200. The ink temperature sensor 282 and the heater 207 are connected to the control circuit board 500, and the heater 207 is controlled to obtain a desired viscosity of ink at the time of printing.

When the ink circulating pump 201 operates, ink is drawn from the collection-side ink chamber 211 through the drawing hole 212 and is transported to the supply-side ink chamber 210 through the ink circulating pump 201 and the discharge hole 213. The pressure inside the supply-side ink chamber 210, which is airtight, increases as the amount of ink increases, and the ink flows into the inkjet head 2 through the ink supply tube 208.

The ink cartridge 81 that supplies the ink to the collection-side ink chamber 211 is arranged relatively below the ink circulating device 3 in the direction of gravity (in the direction of the arrow C). By arranging the cartridge 81 below the ink circulating device 3, the water head pressure of the ink in the ink cartridge 81 is maintained lower than a set pressure of the collection-side ink chamber 211. This configuration allows the ink I to be supplied to the collection-side ink chamber 211 only when the ink supply pump 202 is driven.

The ink circulating device 3 circulates ink by supplying the ink I to the inkjet head 2, collecting the ink I that remains after a portion is discharged from the nozzles 51, and supplying the collected ink to the inkjet head 2 again. The ink circulating device 3 transports ink downward (in the direction of the arrow C which is the direction of gravity) through the ink supply tube 208, and the inkjet head 2 discharges ink further downward.

The meniscus 290 is formed in the nozzle 51 of the inkjet head 2. Ink, when being discharged from the nozzle 51, breaks the meniscus 290 which is an interface between the ink and the air and is discharged as an ink drop. When the pressure applied to the ink at the meniscus 290 is higher than atmospheric pressure (positive pressure), the ink leaks from the nozzle 51. When the pressure applied to the meniscus 290 is lower than atmospheric pressure (negative pressure), ink maintains the meniscus 290 and remains in the nozzle 51. Thus, when ink is not discharged, the pressure of ink in the ink pressure chamber 150 is adjusted to −0.5 to −4.0 kPa (gauge pressure), and the meniscus 290 is maintained. Since the nozzles 51 are arranged to discharge ink in the downward direction of gravity, when the pressure on the ink at the nozzle 51 is over the range (positive pressure), a slight vibration and the like may cause the ink to leak from the nozzle. When the pressure of the nozzle 51 is below the range (negative pressure), air is drawn from the nozzle, and a discharge failure occurs. Generally, the pressure of the ink in the ink pressure chamber 150 is maintained to be negative. When the actuator 54 operates, ink pressure in the ink pressure chamber becomes positive and the ink is discharged from the nozzle 51. The resistances of the flow paths of ink from each of the supply-side ink chamber 210 and the collection-side ink chamber 211 to the nozzles 51 of the inkjet head 2 are substantially the same. Since the resistances of the flow paths are substantially the same, adding the average value of pressure corresponding to difference between the nozzle face and the water head in both of the ink chambers to the average value of the pressure of the second gas chamber 360 and the pressure of the first gas chamber 350 yields the pressure of the nozzle 51. By adjusting pressure of the ink in the pressure adjusting unit 5 so that the pressure of the ink at the nozzles 51 becomes a predetermined pressure, discharge of ink can be more reliably controlled.

Figure 8:
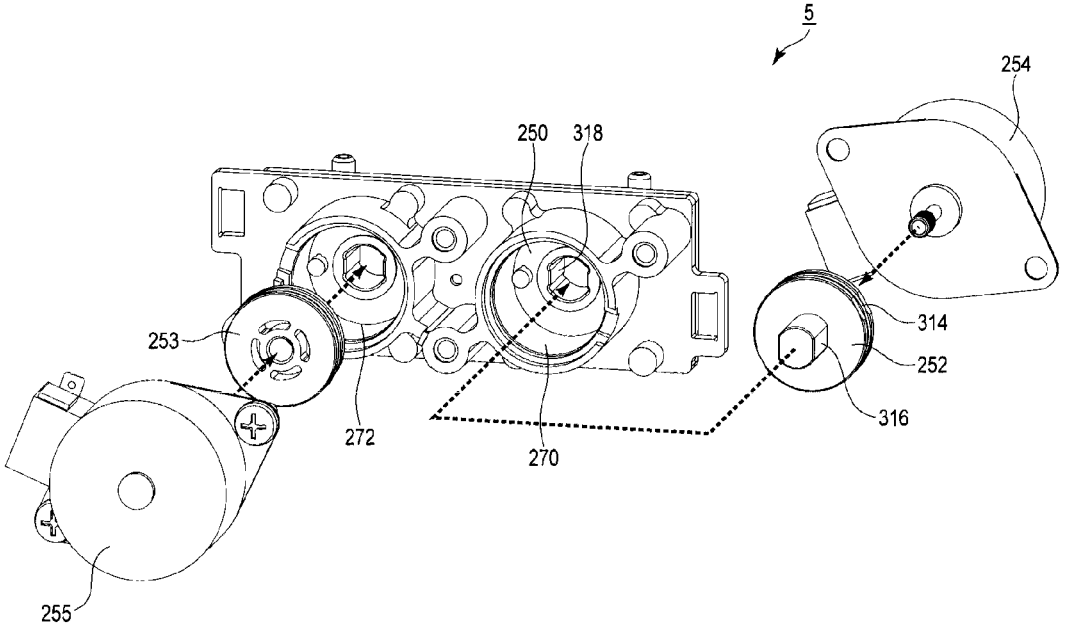
FIG. 8 is an exploded perspective view of a pressure adjusting unit in the ink jet printing apparatus according to the first embodiment.
Figure 9:
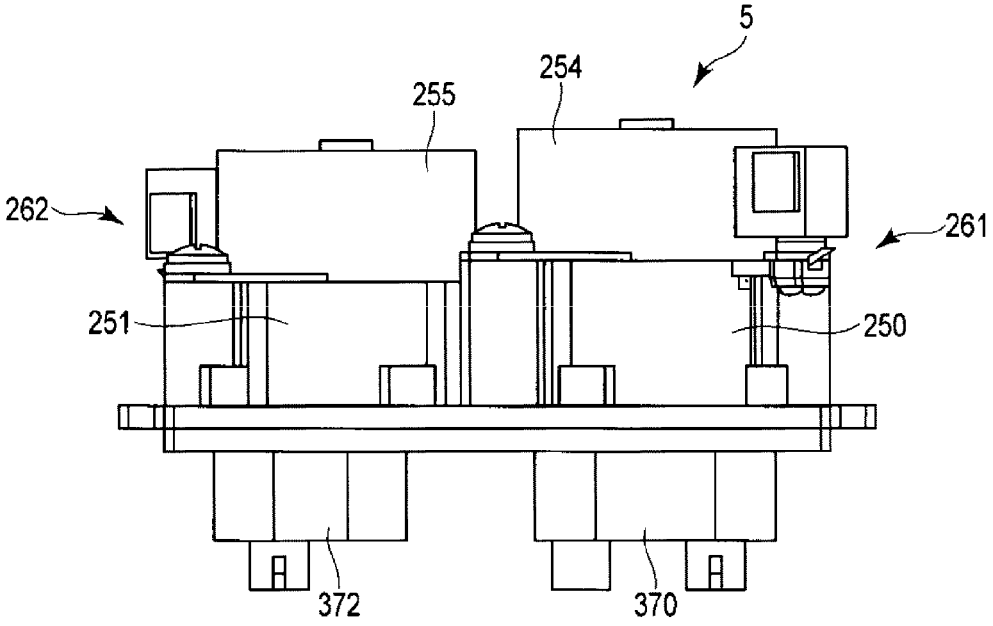
FIG. 9 is a side view of the pressure adjusting unit according to the first embodiment.
Figure 10:
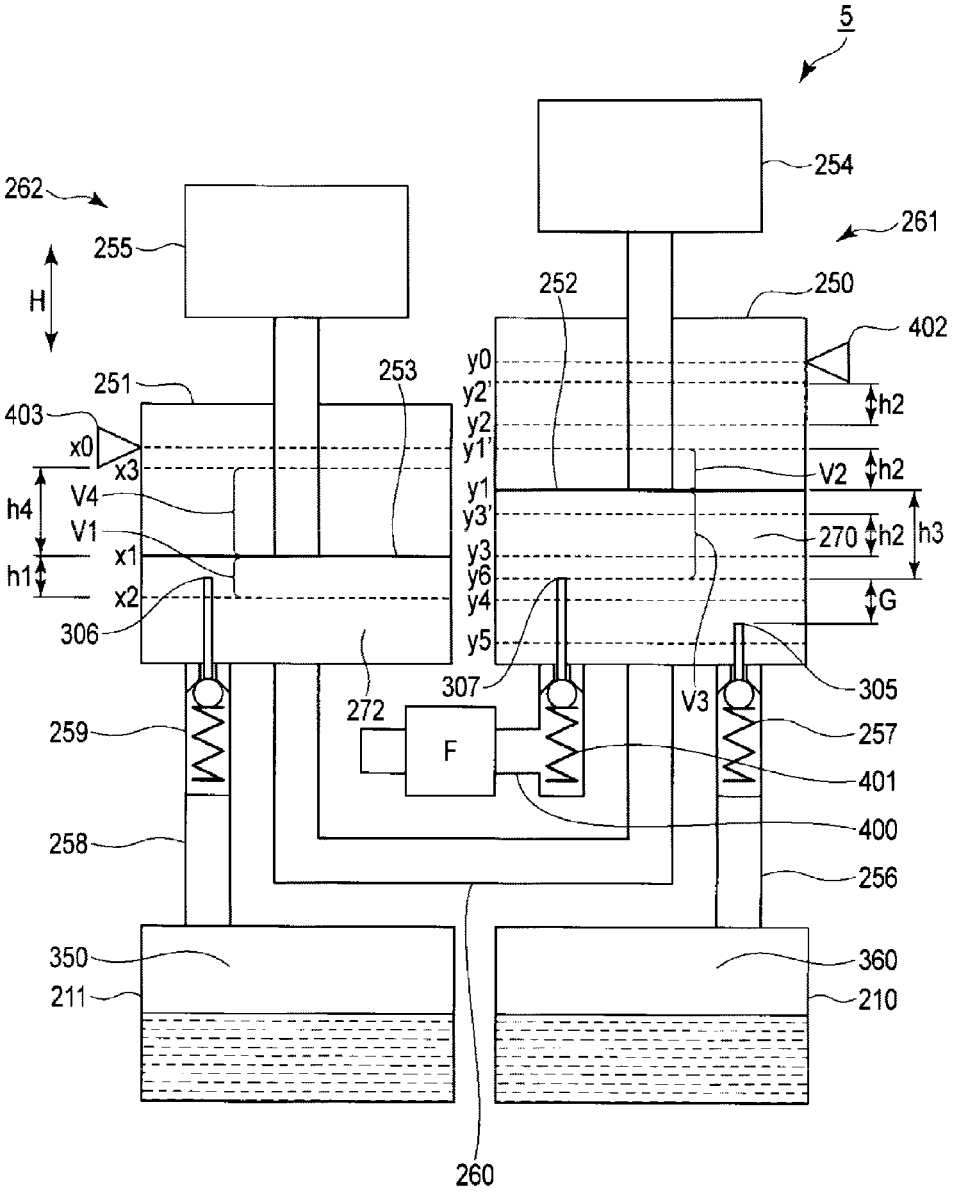
FIG. 10 is a descriptive diagram of the pressure adjusting unit according to the first embodiment.

The pressure adjusting unit 5 will be described with reference to FIG. 8 to FIG. 10. FIG. 8 is an exploded perspective view of the pressure adjusting unit 5, FIG. 9 is a side view of the pressure adjusting unit 5, and FIG. 10 is a descriptive diagram of the pressure adjusting unit 5.

The pressure adjusting unit 5 is arranged on the ink casing 200 of the circulating device 3. The pressure adjusting unit 5 adjusts the pressure inside the ink casing 200 so as to appropriately maintain the pressure of the ink at the nozzle 51 of the inkjet head 2. The pressure adjusting unit 5 includes two pressure adjusting chambers 261 and 262.

The pressure adjusting chamber 261 includes a cylinder 250 that forms a fourth gas chamber 270, a piston 252 that is a first movable member and accommodated in the cylinder 250, and a pulse motor 254 that is a first volume changing unit and changes the volume of the cylinder 250 by causing the piston 252 to reciprocate, for example, in directions designated by H.

The fourth gas chamber 270 formed in the cylinder 250 communicates with the supply-side ink chamber 210 through a communication duct 256 and is able to be opened and closed with respect to the atmosphere through a communication duct 400. A second opening and closing member 257, including a spring, is provided in the communication duct 256. The second opening and closing member 257 closes the communication duct 256 (passageway) between the cylinder 250 and the second gas chamber 360 in the supply-side ink chamber 210 by the bias of the spring and opens the communication duct 256 when being biased by the piston 252.

An opening and closing member (third opening and closing unit) 401, including a spring, is provided on the communication duct 400. The opening and closing member 401 closes the communication duct 400 (passageway) from the atmosphere by the bias of the spring and opens the communication duct 400 to the atmosphere when being biased by the piston 252. A filter F is arranged at an atmosphere intake port of the communication duct 400. A rubber seal material 314 is mounted on the piston 252 and maintains the inside of the cylinder 250 in an airtight manner.

A male screw is fixed to a rotor shaft of the pulse motor 254, and a female screw is formed at an engaging portion of the piston 252. A shaft 316 in a central portion of the piston 252 is a protrusion around a flat portion of the piston 252. The shaft 316 slidably engages with a tubular shaft hole 318 that is arranged in the cylinder 250 and that has a flat face on the periphery and prevents the rotation of the piston 252. The piston 252 slides up and down in the cylinder 250 by the rotation of the pulse motor 254 and changes pressure by changing the volume of the fourth gas chamber 270 that is enclosed by the cylinder 250 and the piston 252.

The pressure adjusting chamber 262 includes a cylinder 251 that communicates with the collection-side ink chamber 211, a piston 253 that is a second movable member and accommodated in the cylinder 251, and a pulse motor 255 that is a second volume changing unit and changes the volume of the cylinder 251 by causing the piston 253 to reciprocate, for example, in the directions designated by H.

Pressure of the air is changed by changing the volume of a third gas chamber 272 that is enclosed by the cylinder 251 and the piston 253. Configurations of the cylinder 251, the piston 253, and the pulse motor 255 are the same as the configurations of those of the pressure adjusting chamber 261.

The cylinder 251 includes a communication duct 258 that communicates with the collection-side ink chamber 211. An opening and closing member 259, including a spring, is provided on the communication duct 258. The opening and closing member 259 is a first opening and closing unit that closes, by the bias of the spring, a communication hole which allows the cylinder 251 to communicate with the first gas chamber 350 in the collection-side ink chamber 211 and opens the communication hole when being biased by the piston 253. The piston 253 slides up and down in the cylinder 251 by the rotation of the pulse motor 255 and changes pressure of the air by changing the volume of the third gas chamber 272 that is enclosed by the cylinder 251 and the piston 253.

The first gas chamber 350 communicates with a fifth gas chamber 352 through a passageway arranged in the projecting portion 372 and through an opening 351. The fifth gas chamber 352 is above the first gas chamber 350. A communication path 223 that leads to a detecting unit of a pressure sensor 204 is arranged in the fifth gas chamber 352. The second gas chamber 360 that includes the air which is in contact with the surface a of the ink in the supply-side ink chamber 210 communicates with a sixth gas chamber 362 through a passageway arranged in the projecting portion 370 and through an opening 361. A communication path 222 that leads to the detecting unit of the pressure sensor 204 is arranged in the sixth gas chamber 362.

The pressure sensor 204 detects the pressure of the air in each of the second gas chamber 360 of the supply-side ink chamber 210 and the first gas chamber 350 of the collection-side ink chamber 211. The pressure sensor 204 includes two pressure detection ports on one chip, communicates with the first gas chamber 350 and the second gas chamber 360, and measures the pressures in the first gas chamber 350 and the second gas chamber 360. The pressure sensor 204 is connected to the control circuit board 500 and outputs the pressure of the air in the supply-side ink chamber 210 and the pressure of the air in the collection-side ink chamber 211, as an electrical signal.

A communication channel 260 that allows the cylinder 250 of the pressure adjusting chamber 261 to communicate with the cylinder 251 of the pressure adjusting chamber 262 at all times is arranged between the cylinder 250 and the cylinder 251.

That is, the pressure adjusting unit 5 includes the third gas chamber 272, the opening and closing member (first opening and closing unit) 259, the fourth gas chamber 270, the opening and closing member (second opening and closing unit) 257, the communication channel 260, the opening and closing member (third opening and closing unit) 401, the piston (second movable member) 253, and the piston (first movable body) 252.

The pressure adjusting unit 5 adjusts the pressure of the air, i.e., the ink, in the ink casing 200 and maintains the meniscus 290 of the inkjet head 2 by changing the volume of air in the cylinders 250 and 251 by moving each of the pistons 252 and 253 up and down and by opening and closing flow paths by switching the opening and closing members.

An operation of the pressure adjusting unit 5 will be described with reference to FIG. 10. Reference signs x1 and y1 indicate home positions of the piston 252 and the piston 253, respectively. The home position x1 is a position where the piston 253 does not abut a tip end 306 of the opening and closing member 259 and where the communication duct 258 is in a closed state. The home position y1 is a position where the piston 252 does not press a tip end 305 of the opening and closing member 257 and where the communication duct 258 is in a closed state.

A position x2 is a position where the piston 253 presses the tip end 306 of the opening and closing member 259 and opens the opening and closing member 259. The home position x1 is separated from the position x2 by a stroke h1, and the stroke h1 is a distance by which the piston 253 may move to press the opening and closing member 259.

A reference sign y1' is a position at which the piston 252 at the home position y1 moves by h2 upward in the direction H such that the sum of the volumes of the third gas chamber 272 and the fourth gas chamber 270 is constant. A volume V1 in which the piston 253 moves by the stroke h1 is set to be the same as a volume V2 in which the piston 252 moves by a stroke h2. When the cross-sectional area the cylinder 251 is the same as that of the cylinder 250, h1=h2 is satisfied.

A position y2' is the upper limit position to which the piston 252 can reach when pressure adjustment is performed. A reference sign y2 is a position to which the piston 252 at the upper limit y2' moves by h2 downward in the direction H, such that the sum of the volumes of the third gas chamber 272 and the fourth gas chamber 270 is constant.

A position y3' is the lower limit position to which the piston 252 can reach when pressure adjustment is performed. A reference sign y3 indicates a position to which the piston 252 at the lower limit position y3' moves by h2 downward in the direction H, such that the sum of the volumes of the third gas chamber 272 and the fourth gas chamber 270 is constant. The position y3 is set at a distance from a tip end 307 of the opening and closing member 401 so that the piston 252 at y3 does not abut the tip end 307 of the opening and closing member 401. A position y4 is a position where the piston 252 opens the opening and closing member 401, and a position y5 is a position where the piston 252 opens the opening and closing member 257.

A procedure for opening the first gas chamber 350 to the atmosphere will be described. First, when the piston 253 is at the position x2 where the piston 253 opens the opening and closing member 259, the piston 253 is moved to the position x1 where the piston 253 closes the opening and closing member 259 so that a pressure change caused by the pressure adjusting unit 5 does not affect pressure of the air in the first gas chamber 350.

Next, the piston 252 moves to the position y4 and opens the opening and closing member 401. At this time, the volume of the fourth gas chamber 270 is compressed, and the pressure in the fourth gas chamber 270 and in the third gas chamber 272 that communicates with the fourth gas chamber 270 increases. However, since the opening and closing member 259 is closed, a pressure change does not affect the pressure of the air in the first gas chamber 350. When the piston 252 opens the opening and closing member 401, the pressure of the air in the fourth gas chamber 270 and in the third gas chamber 272 becomes atmospheric pressure.

Next, the piston 253 moves to the position x2 where the piston 253 opens the opening and closing member 259. At this time, the volume of the third gas chamber 272 is decreased until the piston 253 contacts the tip end 306 of the opening and closing member 259. However, the pressure of the third gas chamber 272 is still atmospheric pressure because the opening and closing member 401 is opened to cause the third gas chamber 272 to be open to the atmosphere. When the piston 253 moves to the position x2 where the piston 253 is in contact with and presses the tip end 306 of the opening and closing member 259, the first gas chamber 350 becomes open to the atmosphere through the third gas chamber 272 and the fourth gas chamber 270.

A procedure for opening the second gas chamber 360 to the atmosphere will be described. When the piston 253 is at the position x2 where the piston 253 opens the opening and closing member 259, the piston 253 is moved to the position x1 where the piston 253 closes the opening and closing member 259 so that a pressure change caused by the pressure adjusting unit 5 does not affect the first gas chamber 350.

Next, the piston 252 moves to the position y5 where the piston 252 presses and opens the opening and closing member 257. At this time, the volume of the fourth gas chamber 270 is decreased until the piston 252 contacts the tip end 307 of the opening and closing member 401, and the pressure of the air in the fourth gas chamber 270 and the third gas chamber 272 increases. However, since the opening and closing member 259 is closed, a pressure change does not affect the pressure of the air in the first gas chamber 350.

The pressure of the air in the fourth gas chamber 270 and the third gas chamber 272 becomes atmospheric pressure when the piston 252 presses and opens the opening and closing member 401. At this time, in the case of a positional relationship in which the tip end 307 of the opening and closing member 401 is pressed after the tip end 305 of the opening and closing member 257 is pressed, the compressed air flows into the second gas chamber 360 and may cause a rapid pressure change to the air in the second gas chamber 360. To avoid this issue, a distance G is set, such that the piston 252 first abuts the tip end 307 of the opening and closing member 401 and then abuts the tip end 305 of the opening and closing member 257.

When the piston 252 moves to the position y5 where the piston 252 is in contact with and presses the tip end 305 of the opening and closing member 257, the second gas chamber 360 becomes open to the atmosphere through the fourth gas chamber 270. Since the opening and closing member 259 is closed, the first gas chamber 350 is not open to the atmosphere.

A procedure for opening the first gas chamber 350 and the second gas chamber 360 to the atmosphere will be described. The piston 253 moves to the position x2 where the piston 253 presses and opens the opening and closing member 259 in the state where the second gas chamber 360 is open to the atmosphere. At this time, the volume of the third gas chamber 272 is decreased until the piston 253 contacts the tip end 306 of the opening and closing member 259. However, the pressure of the air in the third gas chamber 272 is still atmospheric pressure because the opening and closing member 401 is opened to cause the third gas chamber 272 to be open to the atmosphere. When the piston 253 moves to the position x2 where the piston 253 presses the tip end 306 of the opening and closing member 259 and opens the opening and closing member 259, the first gas chamber 350 becomes open to the atmosphere through the third gas chamber 272 and the fourth gas chamber 270. The second gas chamber 360 also becomes open to the atmosphere through the fourth gas chamber 270.

Next, a procedure for returning the piston 252 from the position y4 where the piston 252 opens the opening and closing member 401 to the home position y1 and closing the opening and closing member 401 will be described.

The piston 253 moves to the position x1 while the piston 252 is at the position y4 when the first gas chamber 350 is open to the atmosphere.

The piston 252 moves to the position y4 when the second gas chamber 360 is open to the atmosphere.

The piston 253 moves to the position x1, and then the piston 252 moves to the position y4 when the first gas chamber 350 and the second gas chamber 360 are open to the atmosphere. Afterward, when the piston 252 moves to a position y6 where the piston 252 is in contact with the tip end 307 of the opening and closing member 401, the opening and closing member 401 is closed.

The fourth gas chamber 270 and the third gas chamber 272 that communicates with the fourth gas chamber 270 are in an airtight state when the opening and closing member 401 is closed. Thus, the pressure of the air in the fourth gas chamber 270 and the third gas chamber 272 decreases by a value corresponding to increase of volume V3 when the piston 252 moves by a stroke h3 from y6 to y1 which is the home position. Thus, when the piston 253 moves from the position x1 to the position x2, the air in the fourth gas chamber 270 and the third gas chamber 272 where pressure is decreased is supplied to the first gas chamber 350, and thus a rapid pressure change may affect the air in the first gas chamber 350. In order to avoid such a rapid pressure change, the piston 253 moves by a distance h4 from the position x1 to a position x3 while the piston 252 is at the position y4, that is, while the fourth gas chamber 270 and the third gas chamber 272 are open to the atmosphere.

Afterward, the piston 252 moves from the position y4 to the position y1 via the position y6. At this time, the pressure in the fourth gas chamber 270 and in the third gas chamber 272 that communicates with the fourth gas chamber 270 decreases by the volume V3 in which the piston 252 moves by the distance h3 from the position y6 to the position y1.

Afterward, the piston 253 moves from the position x3 to the position x1. At this time, the pressure of the air in the fourth gas chamber 270 and the third gas chamber 272 decreases by a value corresponding to decrease of volume V4 when the piston 253 moves by the distance h4 of movement from the position x3 to the position x1.

When V3=V4 is met, the total volume of the fourth gas chamber 270 and the third gas chamber 272 is the same when the piston 253 is at the position x3 and the piston 252 is at the position y6 and when the piston 253 is at the position x1 and the piston 252 is at the position y1.

The pressure of the fourth gas chamber 270 and the third gas chamber 272 is atmospheric pressure when the piston 252 is at the position y6, that is, when the piston 252 closes the opening and closing member 401. Thus, atmospheric pressure is maintained when the piston 253 and the piston 252 are respectively at the position x1 and at the position y1.

When V3>V4 is met, the total volume of the fourth gas chamber 270 and the third gas chamber 272 is greater when the piston 253 is at the position x1 and the piston 252 is at the position y1 than when the piston 253 is at the position x3 and the piston 252 is at the position y6. That is, the pressure of the fourth gas chamber 270 and the third gas chamber 272 decreases by a volume corresponding to a difference of volume (V3−V4). By adjusting this volume, pressure adjustment may resume after the pressure of the first gas chamber 350 is set to the pressure before the first gas chamber 350 is open to the atmosphere.

When V3<V4 is met, the total volume of the fourth gas chamber 270 and the third gas chamber 272 is smaller when the piston 253 is at the position x1 and the piston 252 is at the position y1 than when the piston 253 is at the position x3 and the piston 252 is at the position y6. That is, the pressure of the fourth gas chamber 270 and the third gas chamber 272 increases by a value corresponding to a difference of volume (V4−V3).

The piston 252 cannot move further for pressure adjustment when the piston 252 reaches the upper limit position y2' or the lower limit position y3'.

However, even when the piston 252 is at the position y2' or at the position y3', the piston 253 may move from the position x2 to the position x1 such that a pressure change does not affect the air in the first gas chamber 350. Therefore, first, the piston 253 moves from the position x2 to the position x1, and at the same time, the piston 252 moves from the position y2' to the position y2 or from the position y3' to the position y3. In this state, the piston 252 moves to the position y4 and opens the opening and closing member 401, and the fourth gas chamber 270 and the third gas chamber 272 are open to the atmosphere. Afterward, by performing the procedure for returning the piston 252 from the position y4 where the piston 252 presses and opens the opening and closing member 401 to the home position y1 and closing the opening and closing member 401, the piston 252 may return to the position y1 in the state of pressure prior to pressure adjustment.

Figure 11:
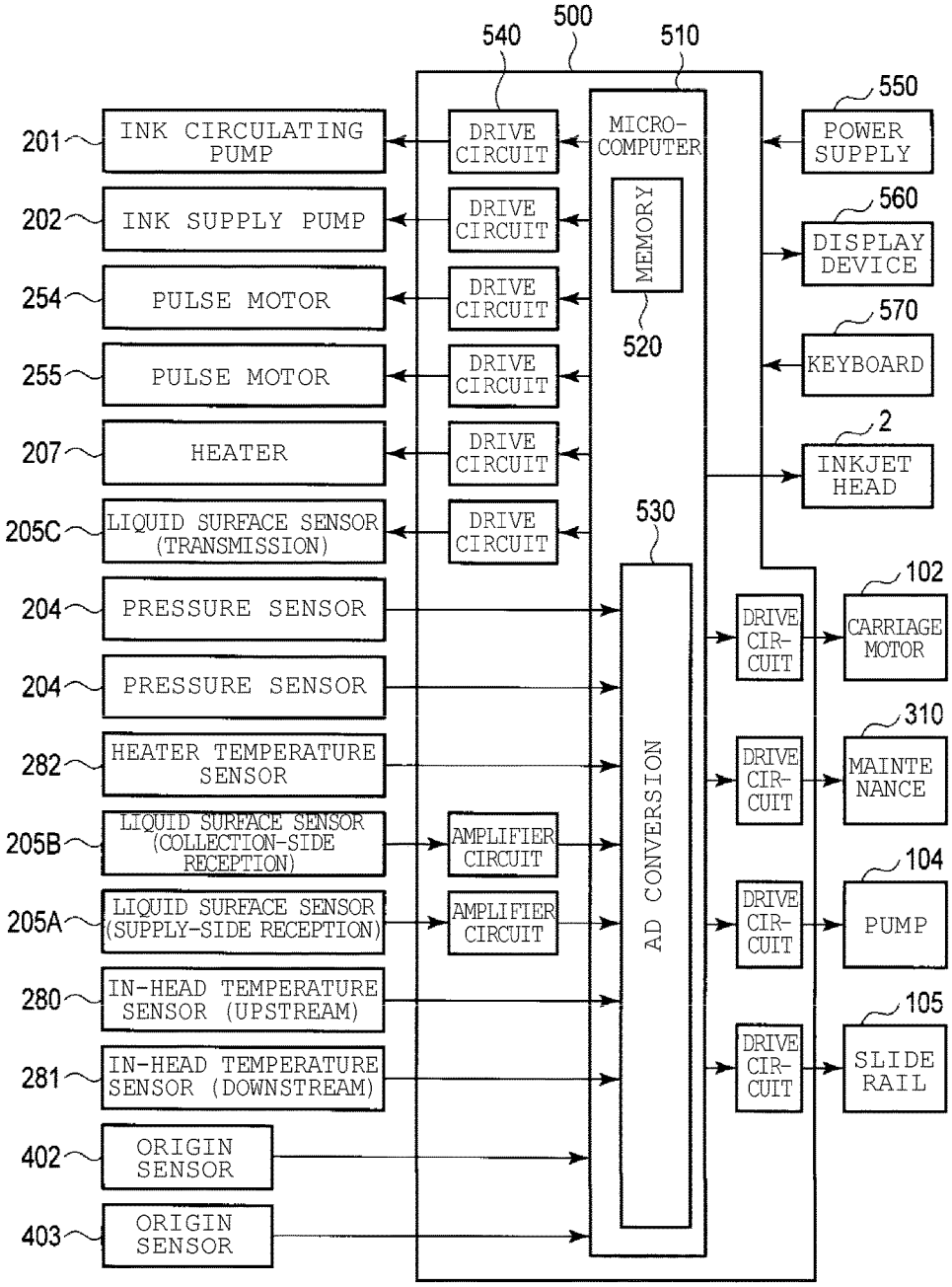
FIG. 11 is a block diagram illustrating a control relationship in the inkjet printing apparatus.

FIG. 11 is a block diagram of the control circuit board 500 that controls an operation of the inkjet printing apparatus 1. A power supply 550, a display device 560 that displays the status of the inkjet printing apparatus 1, and a keyboard 570 as an input device are connected to the control circuit board 500. The control circuit board 500 includes a microcomputer 510 that is a control unit which controls an operation of the control circuit board 500, a memory 520 that stores a program, and an AD converting unit 530 that obtains output voltages of the pressure sensor 204, the in-head temperature sensors 280 and 281, and the ink temperature sensor 282. The control circuit board 500 further includes drive circuits 540 to operate the inkjet printing unit 4, the carriage motor 102 that moves the inkjet printing unit 4 relatively to the printing medium S, the pulse motors 254 and 255 that operate the pistons 252 and 253, the slide rail 105, the pumps 104, 201, and 202, the heater 207, and the like.

[Print Operation]

A print operation of the inkjet printing apparatus 1 will be described. When the inkjet printing apparatus 1 initially performs a print operation, the ink circulating device 3 and the inkjet head 2 are filled with ink supplied from the ink cartridge 81. The microcomputer 510 operates to return the inkjet printing unit 4 to the standby position and raise the maintenance unit 310 so as to cover the nozzle plate 52 when an initial filling operation is instructed from the keyboard.

The microcomputer 510 controls the pressure adjusting unit 5 to cause the pistons 252 and 253 to be at the home positions x1 and y1 as illustrated in FIG. 10. The microcomputer 510 drives the ink supply pump 202 to transport ink from the ink cartridge 81 to the collection-side ink chamber 211 of the ink casing 200 together with the air in the tube 82. At this time, the ink does not flow into the inkjet head 2 and into the supply-side ink chamber 210 in a short period of time because the flow path resistance inside the inkjet head 2 is great.

When the ink amount sensor 205B of the collection-side ink chamber 211 detects ink reaching up to the drawing hole 212, the microcomputer 510 controls the pressure adjusting unit 5 to initiate adjustment of pressure in the ink casing 200 and at the same time, to drive the ink circulating pump 201 for a predetermined period of time. Ink is transported from the collection-side ink chamber 211 to the supply-side ink chamber 210 through the ink circulating pump 201. When each result of detection of the liquid amount in the collection-side ink chamber 211 and in the supply-side ink chamber 212 performed by the piezoelectric sensors 205A and 205B, respectively, indicates that ink reaches the drawing hole 212 and the discharge hole 213 of the circulating pump 201, the ink filling operation ends. When the amount of ink in the collection-side ink chamber 211 is insufficient, the microcomputer 510 drives the ink supply pump 202 to transport ink from the ink cartridge 81 to the collection-side ink chamber 211 of the ink casing 200.

By repeating this operation, the amount of ink in the collection-side ink chamber 211 and in the supply-side ink chamber 210 becomes appropriate, and the initial filling operation is completed. Since the pressure adjusting unit 5 operates while the ink casing 200 is airtight, the pressure of the meniscus 290 in the nozzles 51 is negatively maintained even when a power supply is turned off, and thus the ink does not leak from the nozzles 51.

The pressure sensor 204 outputs pressure as a voltage. When the pressure sensor 204 is used for a long period of time or when environmental conditions (temperature) change, actual pressure and pressure based on the output voltage may be different. To avoid such an issue, by retaining an output voltage value of atmospheric pressure and obtaining pressure (gauge pressure) from the difference between the output voltage value of atmospheric pressure and an output voltage value at the time of pressure detection, accuracy of pressure detection may be maintained. At the timing of retaining the output voltage of the atmospheric pressure, the pressure adjusting chambers 261 and 262 are opened to the atmosphere. Since the pressure of the collection-side ink chamber 211 becomes the atmospheric pressure, the output voltage value at that time is stored on the memory 520 of the control circuit board 500. When the pressure in the ink casing 200 becomes the atmospheric pressure, the meniscus in the nozzles 51 of the inkjet head 2 has positive pressure, and the ink may leak from the nozzles 51. However, as the setting of the pressure in the ink casing 200 to the atmospheric pressure ends in a short period of time. Ink does not leak from the nozzles 51 when the pressure of the collection-side ink chamber 211 is adjusted to a predetermined pressure after the output voltage value of the atmospheric pressure is retained. Storing the output voltage value of the atmospheric pressure in the memory 520 is performed when the power supply of the apparatus is turned on. Alternatively, storing the output voltage value of the atmospheric pressure in the memory may be performed at each certain period of time with a timer incorporated in the apparatus. When the output voltage value is stored in the memory 520 at each certain period of time, a print operation stops if the timing of retaining occurs during the print operation of the inkjet printing unit 4. In order to avoid stopping the print operation, the timing of retaining the output voltage value of the atmospheric pressure is shifted even when a certain period of time elapses in the timer, and the output voltage value is stored in the memory 520 after the print operation ends.

When the printing is initiated, the microcomputer 510 controls the maintenance unit 310 to separate the maintenance unit 310 from the nozzle plate 52. The microcomputer 510 controls the pressure adjusting unit 5 and causes the piston 253 to be at the position x2 and the piston 252 to be at the position y1' to adjust the pressure in the collection-side ink chamber 211. The microcomputer 510 drives the ink circulating pump 201 to circulate ink in order of the collection-side ink chamber 211, the ink circulating pump 201, the supply-side ink chamber 210, the inkjet head 2, and the collection-side ink chamber 211. When the level of the ink surface a that the ink amount sensors 205A and 205B of the supply-side ink chamber 210 and the collection-side ink chamber 211 detect is not a desired level of an ink surface, the microcomputer 510 drives the ink supply pump 202 to supply ink from the ink cartridge 81 to the collection-side ink chamber 211 until the level of the ink surface a becomes a desired level of an ink surface. The microcomputer 510 provides electricity to the heater 207 that is attached to the ink casing 200 and heats the ink to a desired temperature. When the temperature of the ink reaches a desired temperature, the heater is controlled so that the temperature of ink stays in a certain range.

Next, the microcomputer 510 controls the inkjet head 2 to discharge the ink to the printing medium S in accordance with image data that is printed in synchronization with scanning performed by the carriage 100. The microcomputer 510 controls the printing medium moving unit 7 to move the printing medium S by a predetermined distance on the slide rail 105 and repeats discharging of the ink in synchronization with scanning performed by the carriage 100 to form an image on the printing medium S. When the ink is discharged from the inkjet head 2, the amount of the ink in the ink casing 200 instantaneously decreases, and the pressure in the collection-side ink chamber 211 decreases. When the pressure sensor 204 detects the pressure inside the collection-side ink chamber 211 decreasing, the microcomputer 510 controls the pressure adjusting unit 5 and causes the piston 253 to be at the position x2 and the piston 252 to be at the position y1' to adjust the pressure in the collection-side ink chamber 211 and drives the ink supply pump 202 to transport the same amount of ink as the amount of ink discharged to the collection-side ink chamber 211.

The volume of an ink drop discharged from the inkjet head 2 is constant, and the number of ink drops discharged may be computed from the image data. Thus, the amount of used ink is estimated by the product of the volume of an ink drop and the number of ink drops discharged. Thus, the amount of ink in the ink casing 200 immediately returns to a predetermined amount during the print operation.

When there is no ink in the ink cartridge 81, the ink surface in the collection-side ink chamber 211 does not have a desired level even when the ink supply pump 202 is driven for a predetermined period of time. When the ink surface in the collection-side ink chamber 211 does not have a desired level, the display device 560 performs display that indicates the ink cartridge 81 is empty.

Discharge of ink may be favorably maintained by moving the piston 252 of the pressure adjusting chamber 261 that communicates with the first gas chamber 350 such that the pressure of the nozzle 51 becomes a predetermined pressure.

The inkjet printing apparatus 1 forms an image by causing the inkjet printing units 4*a* and 4*b* to reciprocate in the direction orthogonal to the direction of transport of the printing medium S. The longitudinal direction of the nozzle arrangement is the same as the direction of transport of the printing medium S, and the inkjet printing apparatus 1 forms an image having the same width as the 300 nozzles on the printing medium S.

[Pressure Adjusting Operation]

Figure 12:
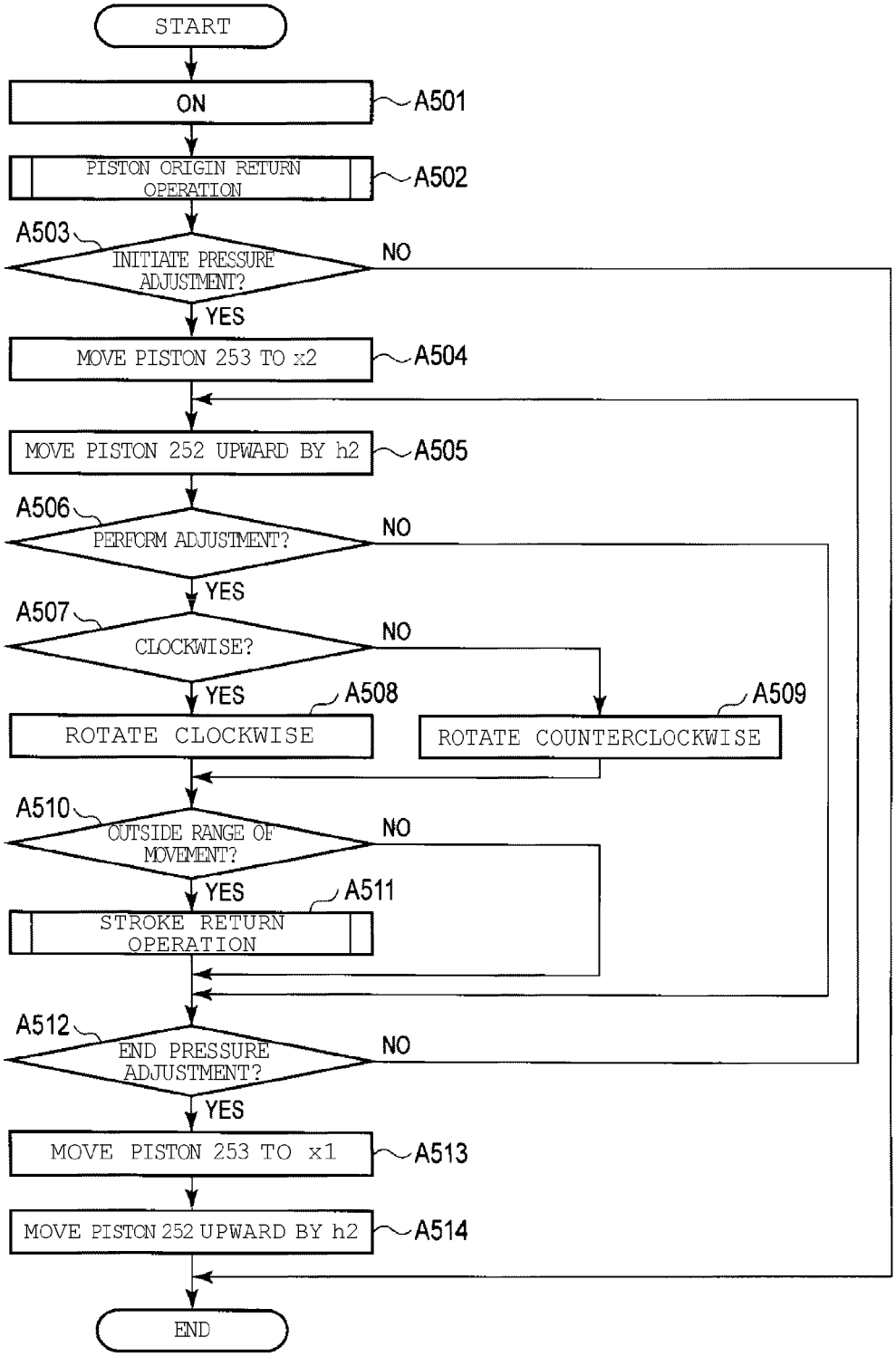
FIG. 12 is a flowchart for a pressure adjusting operation carried out by the inkjet printing apparatus.

Hereinafter, a pressure adjusting procedure will be described with reference to FIG. 12 to FIG. 14.

In the pressure adjusting unit 5, the positions of the pistons 252 and 253 when the power supply is turned on vary depending on positions of the pistons 252 and 253 in the cylinders 250 and 251 when the power supply is previously turned off. Therefore, the positions of the pistons 252 and 253 in the cylinders 250 and 251 are not fixed when the power supply is turned on. Thus, when a user turns the power supply ON (A501), the microcomputer 510 performs origin return (A502). A period of time for preparing movement of the pistons by temporarily moving the pistons 252 and 253 upward is at most a period of time that is required to move the pistons 252 and 253 from the lowest positions in the cylinders 250 and 251 to the positions of the origin sensors 402 and 403 (initial moving time period).

Figure 13:
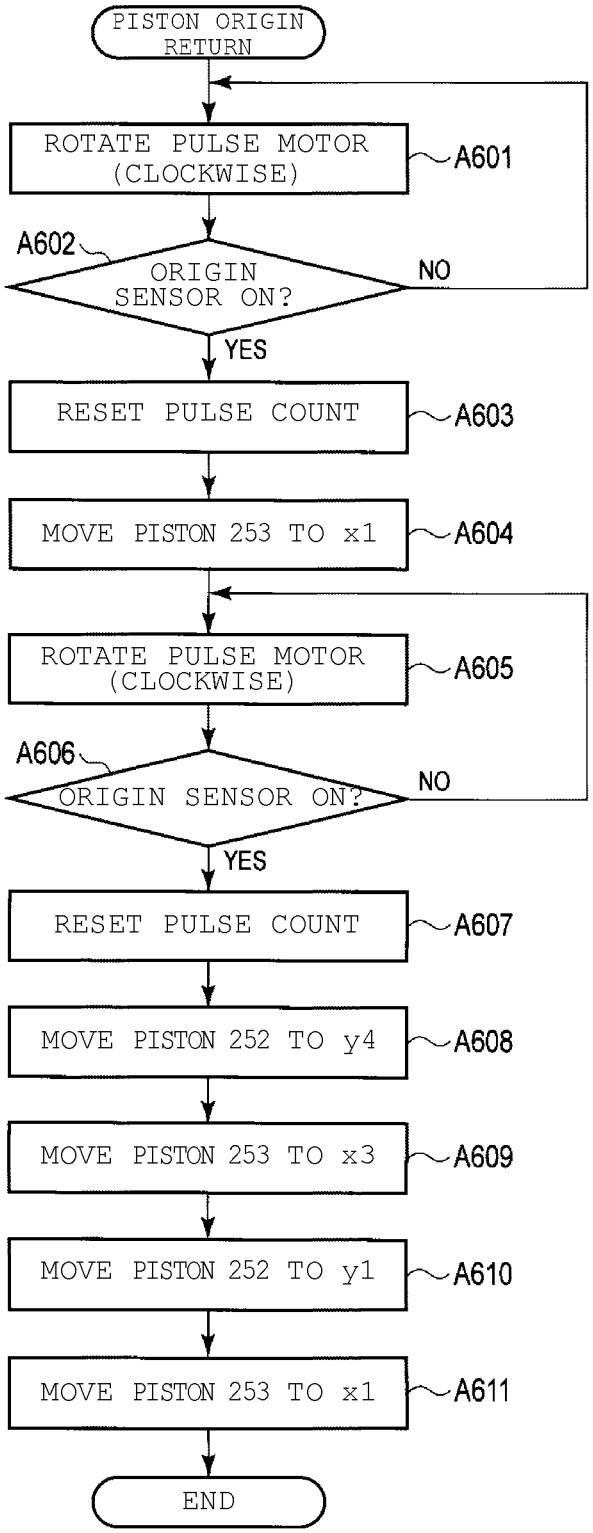
FIG. 13 is a flowchart for an origin return operation carried out by the inkjet printing apparatus.

An origin return procedure is illustrated in FIG. 13. The microcomputer 510 rotates the pulse motor 255 in the direction in which the piston 253 moves toward the origin sensor 403 (A601). The direction toward the origin sensor 403 is the clockwise direction when the male screw fixed to the rotor shaft of the pulse motor 255 and the female shaft arranged in the piston 253 are right-hand screws.

In A602, the microcomputer 510 determines whether the origin sensor 403 is ON. When the sensor is ON (YES in A602), the process proceeds to A603. When the sensor is not ON (NO in A602), the process returns to A601 and the microcomputer 510 rotates the pulse motor 255.

The microcomputer 510 resets a pulse count of the pulse motor 255 (A603) when the piston 253 reaches the position of the origin sensor 403, which is a position x0, and when the sensor is ON (YES in A602).

The microcomputer 510 moves the piston 253 to the home position x1 (A604).

The microcomputer 510 rotates the pulse motor 254 in the direction in which the piston 252 moves toward the origin sensor 402 (A605). The direction toward the origin sensor 402 is the clockwise direction when the male screw fixed to the rotor shaft of the pulse motor 254 and the female screw arranged in the piston 252 are right-hand screws.

In A606, the microcomputer 510 determines whether the origin sensor 402 is ON. When the sensor is ON (YES in A606), the process proceeds to A607. When the sensor is not ON (NO in A606), the process returns to A605, and the microcomputer 510 rotates the pulse motor 254.

The microcomputer 510 resets a pulse count of the pulse motor 254 (A607) when the piston 252 reaches the position of the origin sensor 402, which is a position y0, and when the sensor is ON (YES in A606).

When the origin sensors 402 and 403 are not provided, the microcomputer 510 may move the pistons 252 and 253 to the highest portions (ceilings) of the cylinders 250 and 251 and cause the pulse motors 254 and 255 to be out of step to reset the pulse counts of the pulse motors 254 and 255.

Next, the pistons 252 and 253 moves down to a predetermined position from the positions of the origin sensors 402 and 403, and these positions are set as the home positions thereof. The position x1 is set as the home position of the piston 253, and the position y1 is set as the home position of the piston 252. When the pistons 252 and 253 move afterward, the number of pulses during the movement is counted to recognize positions in the upward or downward direction.

The microcomputer 510 moves the piston 252 to the position y4 to open the opening and closing member 401 and opens the fourth chamber 270 and the third chamber 272 to the atmosphere (A608).

The microcomputer 510 moves the piston 253 to the position x3 and secures an amount of movement h4 (A609). Then, the microcomputer 510 moves the piston 252 to the position y1 (A610). At this time, the pressure of the air in the fourth gas chamber 270 and the third gas chamber 272 that communicates with the fourth gas chamber 270 decreases by a value corresponding to increase of the volume V3 when the piston 252 moves from the position y6 to the position y1 by the distance h3.

Next, the microcomputer 510 moves the piston 253 to the position x1 (A611). At this time, the pressure of the fourth gas chamber 270 and the third gas chamber 272 increases by a value corresponding to decrease of the volume V4 when the piston 253 moves from the position x3 to the position x1 by the distance h4.

The origin return operation is completed as described above. When V3=V4 is met, the pressure of the air in the fourth gas chamber 270 and the third gas chamber 272 finally becomes the atmospheric pressure. Although the positions of the piston 253 and the piston 252 are not determined and the pressure of the air in the pressure adjusting unit 5 as well when the power supply is turned on, the pressure may be initialized by performing such an origin return operation.

When the origin return operation for the piston 253 and the piston 252 ends, the microcomputer 510 determines whether to initiate pressure adjustment (A503). When pressure adjustment is not performed (NO in A503), the microcomputer 510 proceeds to end (END).

When pressure adjustment is performed (YES in A503), the microcomputer 510 moves the piston 253 to the position x2 (A504) to open the opening and closing member 259. At this time, the opening and closing member 259 is opened while the pressure of the air in the third gas chamber 272 increases by a value corresponding to decrease of the volume V1 when the piston 253 moves downward from the position x1 to the position x2 by the distance h1. Thus, the microcomputer 510 moves the piston 252 upward by h2 from the current position so as not to affect the air pressure in the first gas chamber 350 (A505). The volume V2 increased when the piston 252 moves by the distance h2 is the same as the volume V1.

Next, the microcomputer 510 at this time determines whether to perform pressure adjustment (A506). When pressure adjustment is not performed (NO in A506), the process proceeds to A512.

When the microcomputer 510 determines that pressure adjustment is required at that time (YES in A506), the microcomputer 510 determines whether to rotate the pulse motor 254 (A507) clockwise (YES) or counterclockwise (NO). When the determination results in YES in A507, the microcomputer 510 rotates the pulse motor 254 clockwise (A508). When the determination results in NO in A507, the microcomputer 510 rotates the pulse motor 254 counterclockwise (A509).

When the male screw fixed to the rotor shaft of the pulse motor 254 and the female screw arranged in the piston 252 are right-hand screws, the piston 252 moves upward and releases pressure when the pulse motor 254 rotates clockwise. The piston 252 moves downward and applies pressure when the pulse motor 254 rotates counterclockwise.

Next, the microcomputer 510 determines whether the piston 252 is outside the range of possible motion thereof (A510). When the piston 252 is not outside the range of possible motion thereof, that is, when the piston 252 is inside the range of possible motion thereof (NO in A510), the process proceeds to A512.

Whether the piston 252 is outside the preset range of the upper limit position y2' to the lower limit position y3' is determined because the position of the piston 252 may be obtained by counting the number of pulses of the pulse motor 254.

Figure 14:
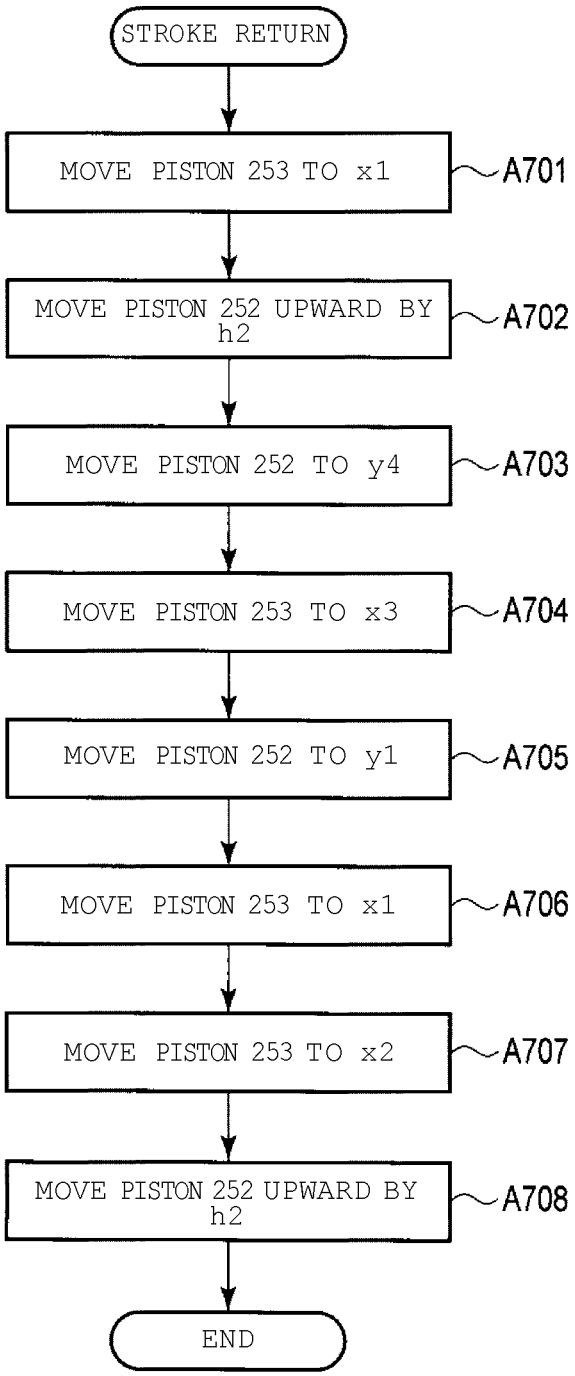
FIG. 14 is a flowchart for a stroke return operation carried out by the inkjet printing apparatus.

When the piston 252 is outside the range of the upper limit position y2' to the lower limit position y3' (YES in A510), a stroke return operation illustrated in the flowchart of FIG. 14 is performed (A511). First, the piston 253 moves to the position x1. That is, the piston 253 closes the opening and closing member 259 (A701). At this time, the opening and closing member 259 is closed while the pressure of the third gas chamber 272 decreases by a value corresponding to increase of the volume V1 when the piston 253 moves upward from the position x2 to the position x1 by the distance h1. Thus, the piston 252 moves downward by h2 from the current position so as not to affect the first gas chamber 350 (A702). The volume V2 increased when the piston 252 moves by the distance h2 is the same as the volume V1.

Next, the piston 252 moves to the position y4 and opens the opening and closing member 401 to open the fourth gas chamber 270 and the third gas chamber 272 to the atmosphere (A703).

Next, the piston 253 moves to the position x3 and secures the amount of movement h4 (A704).

Next, the piston 252 moves to the position y1 (A705). At this time, the pressure of the fourth gas chamber 270 and the third gas chamber 272 decreases by a value corresponding to increase of the volume V3 when the piston 252 moves from the position y6 to the position y1 by the distance h3.

Next, the piston 253 moves to the position x1 (A706). At this time, the pressure of the fourth gas chamber 270 and the third gas chamber 272 increases by a value corresponding to decrease of the volume V4 when the piston 253 moves from the position x3 to the position x1 by the distance h4.

Next, the piston 253 moves to the position x2 (A707) and opens the opening and closing member 259. At this time, the opening and closing member 259 is opened while the pressure of the third gas chamber 272 increases by a value corresponding to decrease of the volume V1 when the piston 253 moves downward from the position x1 to the position x2 by the distance h1. Thus, the piston 252 moves upward by h2 from the current position so as not to affect the first gas chamber 350 (A708). The volume V2 increased when the piston 252 moves by the distance h2 is the same as the volume V1. The stroke return operation is completed as described above.

Next, the microcomputer 510 determines whether to end the pressure adjustment (A512). In the case of not ending pressure adjustment (NO in A512), the process proceeds to A505 and the microcomputer 510 continues the pressure adjustment. In the case of ending the pressure adjustment (YES in A512), the piston 253 moves to the position x1 and closes the opening and closing member 259 (A513). At this time, the opening and closing member 259 is closed while the pressure of the third gas chamber 272 decreases by a value corresponding to increase of the volume V1 when the piston 253 moves upward from the position x2 to the position x1 by the distance h1. Thus, the piston 252 moves downward by h2 from the current position so as not to affect the first gas chamber 350 (A514). The volume V2 increased when the piston 252 moves by the distance h2 is the same as the volume V1. The, the process for the pressure adjustment ends (END). By repeating the sequence above, the stroke return operation may be performed even when the piston 252 reaches the upper limit position y2' or the lower limit position y3'.

According to the circulating device 3 and the inkjet printing apparatus 1 according to the present embodiment, discharge of ink may be favorably maintained by moving the piston 252 of the pressure adjusting chamber 261 that communicates with the first gas chamber 350 such that the pressure of the nozzle 51 becomes a predetermined pressure.

A substantially long stroke may be secured by controlling operations of the plurality of opening and closing members 257, 259, and 401 and the piston 252 when the stroke of the piston 252 reaches the upper limit position or the lower limit position. Therefore, pressure adjustment may be performed even when the piston has a short range of operation, for example, in units of several millimeters. In addition, the above configuration in which the pistons 252 and 253 are used enables control of circulation of ink with a small number of active elements of pulse motors and sensors. Therefore, the inkjet printing apparatus 1 may have a small size. In addition, by decreasing the sizes of the circulating device and the pressure adjusting unit, the circulating device and the pressure adjusting unit may be integrally arranged in the upper portion of the inkjet head 2.

Second Embodiment

Figure 15:
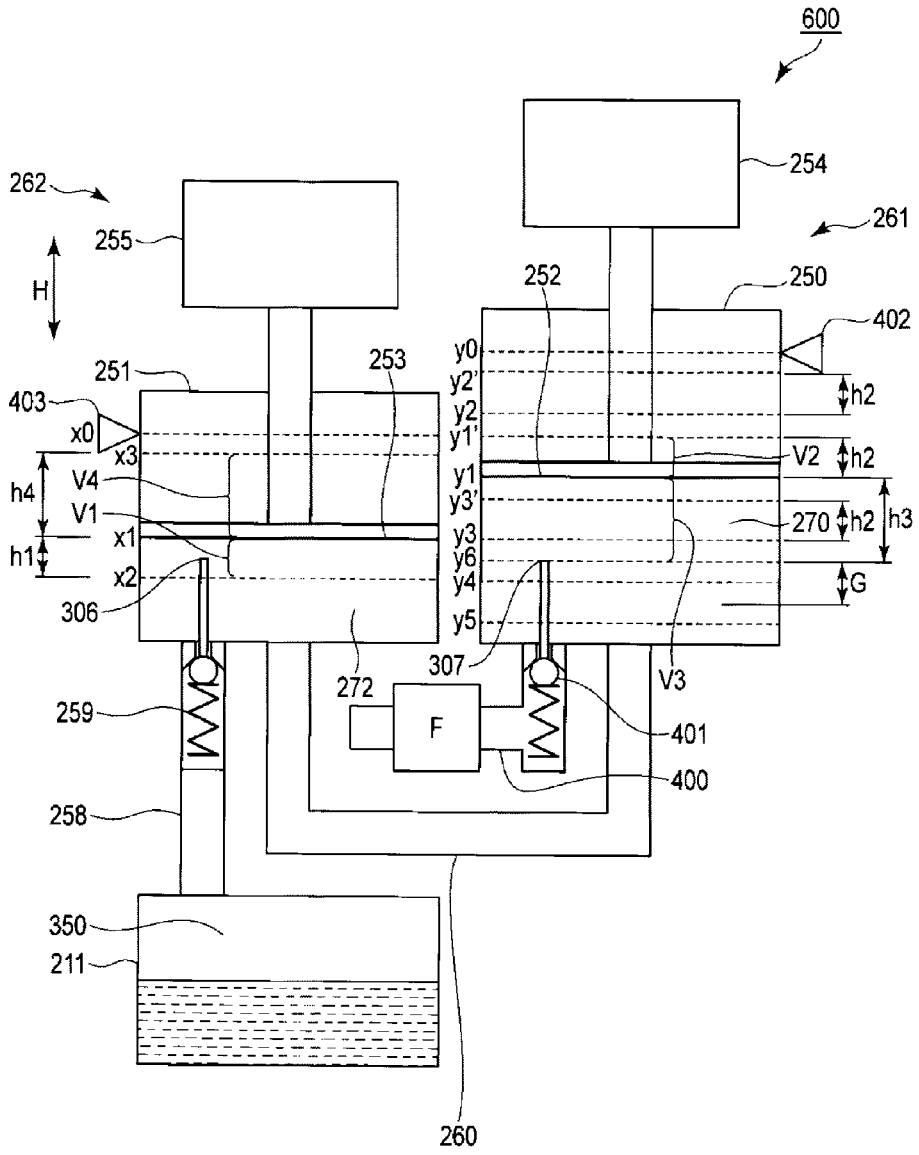
FIG. 15 is a descriptive diagram of a pressure adjusting unit of an inkjet printing apparatus according to a second embodiment.

Hereinafter, a pressure adjusting unit 600 of the inkjet printing apparatus 1 according to a second embodiment will be described with reference to FIG. 15. While the pressure adjusting chamber 261 according to the first embodiment includes the communication duct 256 that causes the fourth gas chamber 270 to communicate with the second gas chamber 360 in the upper portion of the supply-side ink chamber 210, the pressure adjusting unit 600 according to the second embodiment does not include elements corresponding to the communication duct 256 and the opening and closing member 257. Configurations of the pressure adjusting unit 600 are otherwise the same as the configurations of the pressure adjusting unit 5 according to the first embodiment.

The pressure adjusting chamber 261 of the pressure adjusting unit 600 according to the second embodiment includes the cylinder 250, the piston 252 that is accommodated in the cylinder 250, and the pulse motor 254 that changes the volume of the cylinder 250 by moving the piston 252 up and down (in the directions designated by H). Pressure is changed by changing the volume of the fourth gas chamber 270 that is enclosed by the cylinder 250 and the piston 252.

The piston 252 slides up and down in the cylinder 250 by the rotation of the pulse motor 254. The cylinder 250 includes the communication duct 400 that causes the cylinder 250 to communicate with the atmosphere. A spring and the opening and closing member 401 are provided on the communication duct 400. The opening and closing member 401 is the third opening and closing unit that closes a communication hole, which leads to the atmosphere, by the bias of the spring and opens the communication hole when being biased by the piston 252. The filter F is arranged at an atmosphere intake port.

The pressure adjusting chamber 262 includes the cylinder 251 that communicates with the collection-side ink chamber 211, the piston 253 that is accommodated in the cylinder 251, and the pulse motor 255 that changes the volume of the cylinder 251 by moving the piston 253 up and down (in the directions designated by H). Pressure is changed by changing the volume of the third gas chamber 272 that is enclosed by the cylinder 251 and the piston 253. Configurations of the cylinder 251, the piston 253, and the pulse motor 255 are the same as a configuration of the pressure adjusting chamber 261. The cylinder 251 includes the communication duct 258 that communicates with the collection-side ink chamber 211. A spring and the opening and closing member 259 are provided on the communication duct 258. The opening and closing member 259 is the first opening and closing unit that closes, by the bias of the spring, a communication hole which causes the cylinder 251 to communicate with the first gas chamber 350 in the collection-side ink chamber 211 and opens the communication hole when being biased by the piston 253.

The communication channel 260 that causes the cylinder 250 of the pressure adjusting chamber 261 to communicate with the cylinder 251 of the pressure adjusting chamber 262 is arranged between the cylinder 250 and the cylinder 251.

The pressure inside the ink casing 200 is adjusted by controlling the upward and downward movement (in the directions designated by H) of the pistons 252 and 253 and controlling opening and closing of the opening and closing members 259 and 401.

The same effect as the first embodiment is achieved in the inkjet printing apparatus 1 according to the present embodiment. In addition, by decreasing the number of components, the inkjet printing apparatus 1 may have a smaller size.

The liquid discharging apparatus is not limited to the configurations of the embodiments described above. For example, the liquid discharging apparatus may discharge liquid other than ink. The liquid discharging apparatus that discharges liquid other than ink, for example, may discharge liquid which includes conductive particles so as to form an interconnect pattern of a printed interconnect substrate.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid discharge apparatus, comprising:

a head including a plurality of nozzles aligned in a longitudinal direction of the head;

a tank unit having a first tank to which liquid from the head is supplied and a second tank from which liquid is supplied to the head, the second tank being connected to the first tank; and a pressure regulator fixed onto both of upper surfaces of the first and second tanks, having a volume-changeable space that is airtightly communicable with the first and second tanks, and configured to change pressure of air in the first and second tanks by changing volume of the space, a length of the pressure regulator in the longitudinal direction being shorter than a length of the tank unit in the longitudinal direction.

2. The liquid discharge apparatus according to claim 1, wherein the tank unit has, on the upper surface, a first recess in which a path to the first tank is formed and a second recess in which a path to the second tank is formed, and the pressure regulator has, on a bottom surface, a first protrusion that fits in the first recess and has a path connected to the space and a second protrusion that fits in the second recess and has a path connected to the space.

3. The liquid discharge apparatus according to claim 1, wherein the head is fixed to a bottom surface of the tank unit.

4. The liquid discharge apparatus according to claim 1, wherein the pressure regulator includes a first pulse motor disposed above the first tank and a second pulse motor disposed above the second tank, the first and second pulse motors being aligned along the longitudinal direction and configured to change the volume of the space.

5. The liquid discharge apparatus according to claim 1, wherein the length of the pressure regulator in the longitudinal direction is shorter than a length of the head in the longitudinal direction.

6. The liquid discharge apparatus according to claim 5, wherein the length of the tank unit in the longitudinal direction is shorter than the length of the head in the longitudinal direction.

7. The liquid discharge apparatus according to claim 1, wherein a height of the pressure regulator is less than a height of the tank unit.

8. The liquid discharge apparatus according to claim 1, wherein a width of the pressure regulator in a width direction perpendicular to the longitudinal direction is substantially equal to a width of the tank unit in the width direction.

9. An inkjet printing apparatus comprising:

a medium conveyer configured to convey a medium in a first direction;

a carriage configured to move in a second direction that crosses the first direction; and a liquid discharge device mounted in the carriage and including:

a head including a plurality of nozzles aligned in a longitudinal direction of the head;

a tank unit having a first tank to which liquid from the head is supplied and a second tank from which liquid is supplied to the head, the second tank being connected to the first tank; and a pressure regulator fixed onto both of upper surfaces of the first and second tanks, having a volume-changeable space that is airtightly communicable with the first and second tanks, and configured to change pressure of air in the first and second tanks by changing volume of the space, a length of the pressure regulator in the longitudinal direction being shorter than a length of the tank unit in the longitudinal direction.

10. The inkjet printing apparatus according to claim 9, wherein the tank unit has, on the upper surface, a first recess in which a path to the first tank is formed and a second recess in which a path to the second tank is formed, and the pressure regulator has, on a bottom surface, a first protrusion that fits in the first recess and has a path connected to the space and a second protrusion that fits in the second recess and has a path connected to the space.

11. The inkjet printing apparatus according to claim 9, wherein the head is fixed to a bottom surface of the tank unit.

12. The inkjet printing apparatus according to claim 9, wherein the pressure regulator includes a first pulse motor disposed above the first tank and a second pulse motor disposed above the second tank, the first and second pulse motors being aligned along the longitudinal direction and configured to change the volume of the space.

13. The inkjet printing apparatus according to claim 12, wherein the first and second pulse motors are aligned along the first direction.

14. The inkjet printing apparatus according to claim 9, wherein the length of the pressure regulator in the longitudinal direction is shorter than a length of the head in the longitudinal direction.

15. The inkjet printing apparatus according to claim 14, wherein the length of the tank unit in the longitudinal direction is shorter than the length of the head in the longitudinal direction.

16. The inkjet printing apparatus according to claim 9, wherein a height of the pressure regulator is less than a height of the tank unit.

17. The inkjet printing apparatus according to claim 9, wherein a width of the pressure regulator in a width direction perpendicular to the longitudinal direction is substantially equal to a width of the tank unit in the width direction.

* * * * *